US007101011B2

(12) United States Patent
Koitabashi et al.

(10) Patent No.: US 7,101,011 B2
(45) Date of Patent: Sep. 5, 2006

(54) RECORDING APPARATUS, METHOD AND PROGRAM UTILIZING COMPENSATION DOTS

(75) Inventors: Noribumi Koitabashi, Kanagawa (JP); Masataka Yashima, Tokyo (JP); Tsuyoshi Shibata, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 421 days.

(21) Appl. No.: 10/285,444

(22) Filed: Nov. 1, 2002

(65) Prior Publication Data

US 2003/0085939 A1 May 8, 2003

(30) Foreign Application Priority Data

Nov. 6, 2001 (JP) ..... 2001-340911
Oct. 23, 2002 (JP) ..... 2002-308373

(51) Int. Cl.
*B41J 29/393* (2006.01)
*B41J 2/21* (2006.01)

(52) U.S. Cl. ..... 347/19; 347/43

(58) Field of Classification Search ..... 347/17, 347/12, 19, 14, 15, 23, 6, 3, 20, 40, 49, 67, 347/56, 60, 9, 24, 5, 11, 43; 358/298, 302, 358/502, 505

See application file for complete search history.

(56) References Cited

U.S. PATENT DOCUMENTS 4,313,124 A 1/1982 Hara
4,345,262 A 8/1982 Shirato et al.
4,459,600 A 7/1984 Sato et al.
4,463,359 A 7/1984 Ayata et al.
4,558,333 A 12/1985 Sugitani et al.
4,723,129 A 2/1988 Endo et al.
4,740,796 A 4/1988 Endo et al.
5,528,270 A 6/1996 Tajika et al.
5,581,284 A 12/1996 Hermanson
5,587,730 A 12/1996 Karz
5,880,751 A 3/1999 Nishikori et al.
5,894,314 A 4/1999 Tajika et al.
5,909,227 A * 6/1999 Silverbrook ..... 347/3
6,033,054 A 3/2000 Takagi
6,174,039 B1 1/2001 Miyake et al.
2003/0142162 A1* 7/2003 Barr et al. ..... 347/19

FOREIGN PATENT DOCUMENTS

EP 0 983 855 3/2000
EP 1 010 531 6/2000

(Continued)

*Primary Examiner*—Stephen Meier
*Assistant Examiner*—Julian D. Huffman
(74) *Attorney, Agent, or Firm*—Fitzpatrick, Cella, Harper & Scinto

(57) ABSTRACT

A recording system for recording a color image on a recording medium by utilizing a recording head, on which a plurality of recording elements are arranged, includes a compensation unit to compensate a position to be recorded by a recording element which does not execute a recording operation by color dots different from those of that recording element. The compensation unit is controlled such that the number of the compensation dots is less than the number of dots to be formed originally and that lightness per a determined area of an image obtained by the compensation dots is within a range of ±20% of that to be obtained by dots from the recording element which does not execute the recording operation. The recording system can minimize nonuniformity in the recorded image, can make the nonuniformity be unrecognized by human eyes and can suppress increased costs while increasing recording rates.

11 Claims, 34 Drawing Sheets

FOREIGN PATENT DOCUMENTS

| | | |
|---|---|---|
| EP | 1 151 867 | 11/2001 |
| JP | 59-123670 | 7/1984 |
| JP | 59-138461 | 8/1984 |
| JP | 5-301427 | 11/1993 |
| JP | 6-79956 | 3/1994 |
| JP | 2001-315363 | 11/2001 |

* cited by examiner $$AVE = \frac{1}{128} \sum^{1} n(i)$$

$$ave(i) = \{ n(i-1) + n(i) + n(i+1) \} / 3$$

RECORDING APPARATUS, METHOD AND PROGRAM UTILIZING COMPENSATION DOTS

BACKGROUND OF THE INVENTION

1. Field of the Invention

The present invention relates to a recording apparatus and a recording method using a recording head, on which a plurality of recording elements are arranged, when recording. In particular, the present invention relates to a recording apparatus such as an ink-jet recording apparatus and the like using the recording head by ejecting ink from a plurality of nozzles arranged thereon, when recording.

2. Brief Description of the Related Art

Recently recording apparatuses employing an ink-jet method for recording on a recording medium by ejecting ink from nozzles arranged on the recording head, have been widely applied to printers, facsimile machines, copying machines and so forth. Particularly, color printers capable of recording color images by using a plurality of colors have been remarkably widely used as images of high quality have been enhanced with progress of the color printers.

In addition to high quality images, a higher recording rate is an important factor for the recording apparatus to spread widely so that liquid droplet ejection driving frequencies of recording heads have been raised higher along with the increasing number of nozzles arranged in the recording heads for higher-rate recording.

However, in ink-jet apparatuses, sometimes statuses, such as so-called "non-eject" status, where ink droplets can not be ejected, are caused by dust entered into nozzles of the recording head during production of the head and deteriorated nozzles due to a long period use, deteriorated elements for ejecting ink and so forth. In the case of the non-eject status caused by deteriorated nozzles or elements, it is likely that the non-eject status happens casually when the recording apparatuses are in use.

In some cases statuses where ejecting directions of ink droplets are deviated largely from a desired direction (hereinafter also referred as "twisted ejection") and statuses where ejecting volumes of ink droplets are different largely from a desired volume (hereinafter also referred as "dispersion in droplet diameter") are observed instead of non-eject statuses. Since such deteriorated nozzles largely deteriorate quality of recorded images, these nozzles cannot be employed for recording. Hereinafter such nozzles are also included in and explained as the non-eject statuses.

Such non-eject statuses and so forth were not so problematic in the past, since non-eject status generating frequencies could be suppressed by modifying manufacturing conditions and the like. However, the non-eject statuses have become problems not to be ignored, as nozzle numbers have been increased for the above-mentioned higher-rate recording.

In order to manufacture recording heads which do not include nozzles at the non-eject statuses and excellent recording heads which hardly cause the non-eject statuses, manufacturing costs will be increased, which leads to higher cost recording heads.

When the non-eject statuses occur, defects such as white streaks and the like are observed in recorded images. In order to compensate such white streaks, techniques such that white streaks are compensated by recording with other normal nozzles by utilizing a divided recording method where the recording head is scanned a plurality of times for recording.

However, in order to attain the above-mentioned higher-rate recording, it is preferable to finish recording by one scanning, so called "one path recording", but it is very difficult to compensate unrecorded portions due to the non-eject statuses or to make such portions unrecognizable in the one path recording. In another recording method for recording by executing a plurality of scanning on a predetermined area in a recording medium, so called "multi scan", sometimes it is difficult to compensate completely depending on positions or the number of non-eject nozzles.

SUMMARY OF THE INVENTION

The present invention is carried out in view of the above-mentioned problems, and to provide an ink-jet recording apparatus capable of removing unevenness such as white streaks and the like generated in recorded images due to unrecorded dots caused by the non-eject statuses, or making white streaks unrecognizable by human eyes even when the non-eject statuses occur in order to suppress cost increase of the recording head. Further the present invention provides the recording apparatus capable of recording at a higher recording rate.

The following constitution of the present invention solves the problems mentioned above.

(1) A recording apparatus for recording a color image on a recording medium by utilizing a recording head on which a plurality of recording elements are arrayed, so as to record a plurality colors by the recording head, comprises: recording head driving means for driving said plurality of recording elements of the recording head in accordance with image data; and compensation means for compensating a position to be recorded by a recording element which does not execute a recording operation among the recording elements, by different color dots from those of the recording element which does not execute the recording operation, wherein the number of the compensation dots recorded by the compensation means is less than the number of dots to be formed originally by the recording element which does not execute the recording operation, and the lightness per a predetermined area of an image obtained by the compensation dots is within a range of ±20% of the lightness per the predetermined area of the image to be obtained by dots from the recording element which does not execute the recording operation.

(2) The recording apparatus according to (1), wherein the lightness per the predetermined area of the image obtained by the compensation dots is within a range of ±10% of the lightness per predetermined area of the image to be obtained by dots from the recording element which does not execute the recording operation.

(3) The recording apparatus according to (1) or (2), wherein the compensation means has a correction means to correct image data corresponding to the recording element which does not execute the recording operation, in accordance with a recording color for the compensation and executes a compensation recording operation based on the corrected image data by the correction means.

(4) The recording apparatus according either one of (1) to (3), wherein the recording element that does not execute recording operation includes a recording element incapable of executing the recording operation.

(5) The recording apparatus according to any one of (1) to (4), wherein the recording head is an ink-jet head for recording having a plurality of nozzles where ink is ejected from the nozzles when said recording elements are driven.

(6) The recording apparatus according to any one of (1) to (5), wherein the lightness of the compensation dots is lower than the lightness to be recorded by dots from the recording element which does not execute the recording operation.

(7) A recording apparatus for recording a color image on a recording medium by utilizing a recording head on which a plurality of recording elements are arrayed, so as to record a plurality colors by the recording head, comprises: recording head driving means for driving the plurality of recording elements of the recording head in accordance with image data; and compensation means for compensating a position to be recorded by a recording element which does not execute a recording operation among the recording elements, by different color dots from those of the recording element which does not execute the recording operation, wherein the lightness of the compensation dots is lower than the lightness to be recorded by dots from the recording element which does not execute the recording operation, and the number of the compensation dots recorded by the compensation means is less than the number of dots to be formed originally by the recording element which does not execute the recording operation.

(8) A recording method for recording a color image on a recording medium by utilizing a recording head on which a plurality of recording elements are arrayed, so as to record a plurality colors by the recording head, comprises steps of: identifying a recording head which does not execute a recording operation among the plurality of recording elements; recording an image based on image data compensation recording to compensate a corresponding position to be recorded by the identified recording element which does not execute the recording operation during the image recording step, by different color dots, wherein: the number of the compensation dots recorded at the recording step is less than the number of dots to be formed originally by the recording element which does not execute the recording operation; and the lightness per a predetermined area of an image obtained by said compensation dots is within a range of ±20% of the lightness per the predetermined area of the image to be obtained by dots from the recording element which does not execute the recording operation.

(9) The recording apparatus according to (8), wherein: the lightness of the compensation dots is lower than the lightness to be recorded by dots from the recording element which does not execute the recording operation.

(10) A program for controlling a recording apparatus for recording a color image on a recording medium by utilizing a recording head on which a plurality of recording elements are arrayed, so as to record a plurality colors by the recording head, wherein the program runs a computer to control procedures comprising: identifying a recording head which does not execute a recording operation among the plurality of recording elements; when image processing operations to compensate a corresponding position to be recorded by the identified recording element which does not execute the recording operation by different color dots, the following are executed:

(A) controlling the number of the compensation dots compensated by the recording operation to be less than the number of dots to be formed originally by the recording element which does not execute the recording operation; and (B) controlling the lightness per a predetermined area of an image obtained by the compensation dots to be within a range of ±20% of the lightness per the predetermined area of the image to be obtained by dots from the recording element which does not execute the recording operation.

(11) A program for carrying out the method described in (8) or (9).

(12) A recording apparatus having: a recording means for recording a plurality of uniform gradation patterns, some of the nozzles of which are worked so as not to eject ink; and a recording means for recording a plurality of patterns so as to compensate by another color dots by a recording operation on positions corresponding to the worked nozzles so as not to eject ink.

(13) The recording apparatus according to (12), wherein: a compensation method is determined by reading the plurality of recording patterns.

(14) A recording method wherein: a compensation on a non-eject portion is executed by another color based on tables or functions for compensating non-eject nozzles obtained by a calculated defect ratio in one pixel caused by the non-eject portion.

DETAILED DESCRIPTION OF PREFERRED EMBODIMENTS

Figure 1A:
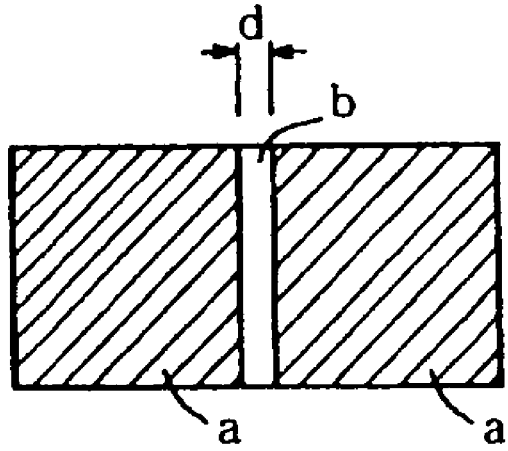
FIG. 1A is a schematic drawing showing a defect status of a recorded image.

Hereinafter preferred embodiments of the present invention are explained.

In this specification nozzles where non-eject statuses occur, nozzles of which eject directions of ink droplets are largely deviated from a desired direction and nozzles which eject ink volumes largely different from a desired ink volume are explained as nozzles in incapable states of recording. In the present invention these nozzles are treated as nozzles which do not execute recording operations or as recording elements which do not execute recording operations. Recording operations to compensate positions not recorded by these nozzles or positions not recorded by these elements can make the errors inconspicuous. Hereinafter embodiments by the present invention are explained in detail. Nozzles or recording elements brought to abnormal recording statuses are also represented as bad nozzles or bad recording elements in this specification.

Here recording methods to compensate unrecorded positions by non-eject nozzles and methods to make white streaks inconspicuous are respectively explained in detail.

<Compensation Through Lightness>

Under-mentioned examples are recording methods in which dots are compensated by different color nozzles instead of nozzles incapable of recording due to generated non-eject statuses or the like. Based on output data (hereinafter also referred to as image data) corresponding to non-eject nozzles where non-eject statuses occur, compensating recording operations are executed by generating output data corresponding to compensating nozzles so that lightness of recorded image (image to be recorded originally) matches lightness of image to be recorded with other color nozzles (compensated recorded image) used for compensation on a predetermined level. More specifically, in order to match lightness per a predetermined area of the above-mentioned image to be recorded originally, to lightness per the predetermined area of the above-mentioned compensated recorded image on the predetermined level, output data corresponding to the color nozzles to be used for the compensation, are generated. When unrecorded portions caused by non-eject statuses are compensated by a recording operation with even another color by matching lightness on the predetermined level as mentioned above, it is possible to make non-eject portions inconspicuous. As one of the methods to measure lightness, for example, a spectrodensitometer X-Rite938 manufactured by X-Rite Co. Ltd. can be utilized. This X-Rite938 can measure lightness, if a sample has a diameter of more than 5 mm or so. Therefore, it is possible to judge whether a difference between the lightness per the predetermined area of the image to be recorded originally and the lightness per the predetermined area of the image to be compensated by the recording operation, is within a certain level (for example ±20%) or not, when the spectrodensitometer mentioned above is employed to measure and compare the above-mentioned two lightness per the predetermined area with the diameter of about 5 mm. The measuring device to measure the lightness is not limited to the above-mentioned X-Rite938, but similar type of measuring devices may be also employable.

It is desirable to select a compensating color having a near chromaticity to that of the non-eject color. A color combination comprising cyan (hereinafter referred as C), magenta (hereinafter referred as M), yellow (hereinafter referred as Y) and black (hereinafter referred as Bk), is employed in ordinary ink-jet printers. Among these colors it is possible to use M having nearly similar lightness to that of C or to use Bk having a relatively near lightness to that of C for compensating non-eject C nozzles. More specifically, data to be recorded by C nozzles are converted to M or Bk data so that a difference in lightness between C and M or Bk is in a predetermined range, and converted M or Bk data are added to original M or Bk data and outputted.

Figure 2:
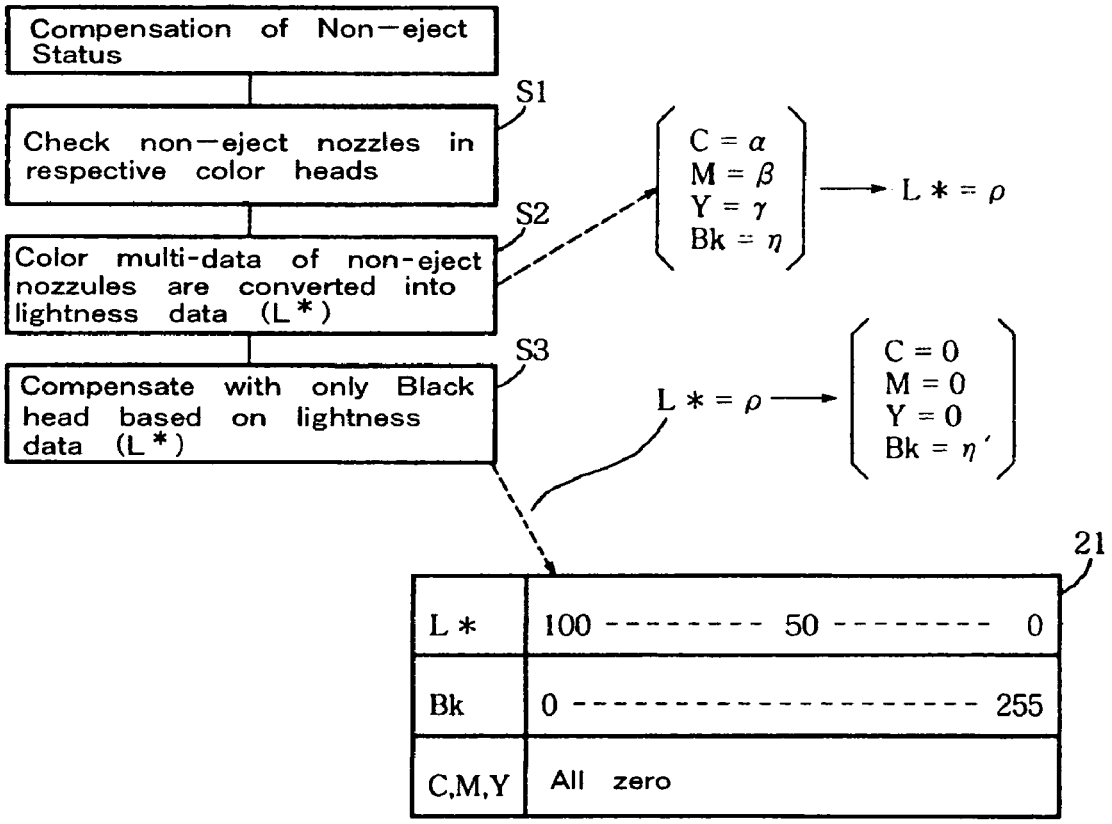
FIG. 2 is a block diagram showing a method for compensating non-eject nozzles of a recording head by using only black ink nozzles in all cases of low recording duty and high recording duty.

Even when non-eject statuses occur, it is possible to compensate non-eject statuses by executing a compensating procedure shown in FIG. 2.

FIG. 2 is the block diagram/the flow chart illustrating the above-mentioned compensation procedure by lightness. At first, a non-eject head and non-eject nozzles are recognized at step S1. More specifically, data on non-eject nozzles detected during manufacturing are written in EEPROM beforehand and are readout afterward, non-eject nozzles are judged from outputted image by a recording apparatus, non-eject nozzles are detected by a sensor.

Various detecting arrangements such as an arrangement to detect eject statuses of ink optically, an arrangement to detect non-eject portions by reading a tentatively recorded image and so forth are applicable to this detecting step.

At step S2, output data (multi-data) on non-eject color are read and data is converted to lightness (hereinafter also referred as L*) of the color. At step S3, data on a color to be used for compensating the non-eject color are generated based on corresponding lightness data of the non-eject nozzle. As mentioned above, the data for the compensation are generated so as to match the lightness to the predetermined level. At this step, a table where output data of respective colors and corresponding lightness of respective colors are stored, can be used for converting output data corresponding to non-eject color. A table 21 shown in FIG. 2 is a table used for the compensation by black ink, which will be explained below.

The present inventors found the fact that an unrecorded portion b with width d in an image as shown in FIG. 1A is recognized as a white streak before the compensation, but when the unrecorded portion b is recorded by another compensating color, the recorded portion b is merged into surrounding colors by adjusting lightness of the compensating color near to that of an original a when the width d is sufficiently narrow even if the compensating color is different from the original color.

Figure 1B:
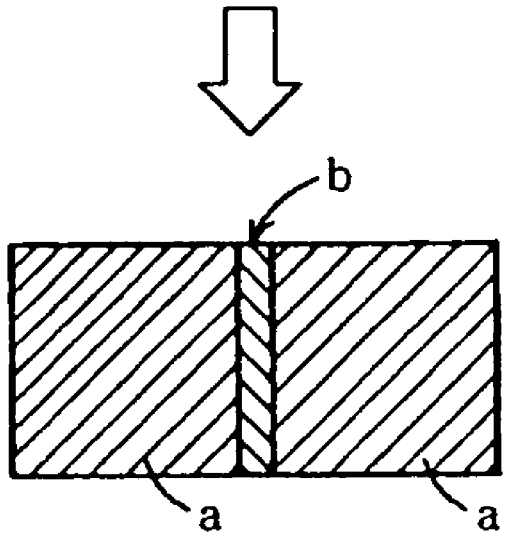
FIG. 1B is a schematic drawing showing a compensated defect shown in FIG. 1A.

FIG. 1A shows a state where the unrecorded portion b with the width d is generated in the image with the color a. FIG. 1B shows a compensated state where the unrecorded portion is compensated by another color so as to bring its lightness closer to that of the original color. Experiments whether the unrecorded portion b without the compensation and the compensated portion by another color, for example, by Bk can be recognized as a nonuniformity or not when a distance between the image to be observed and eyes of an observer is varied, are carried out.

An example of the experiment where a red color with a lightness about 51 is selected for the portion a in FIGS. 1A and 1B and the portion b in FIGS. 1A and 1B is compensated by varying the lightness of a gray color is explained.

Figure 33A:
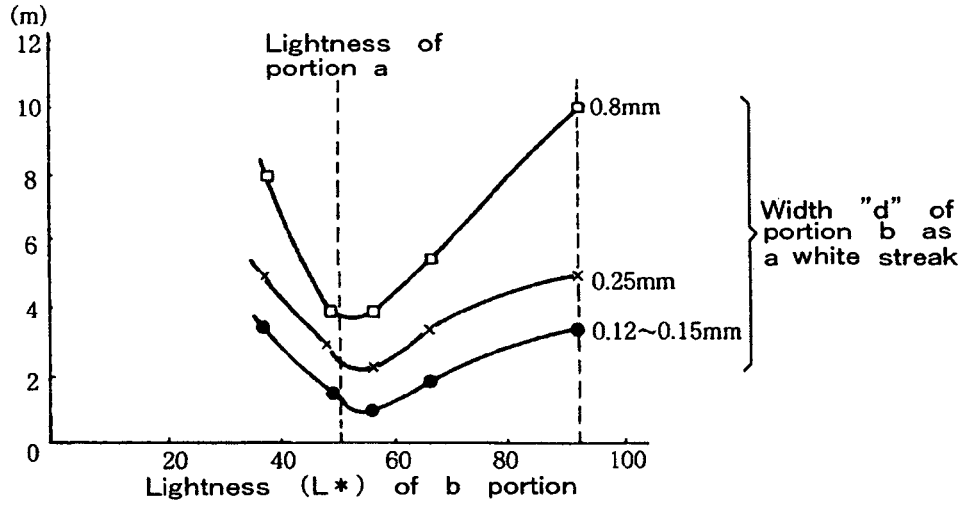
FIG. 33A is a graph showing a relation between lightness in compensated area b in FIG. 1B and distance of distinct vision of the compensated area b.

FIG. 33A is the graph where the axis of abscissa represents lightness (L*, lightness of the portion b) of compensating gray color and the axis of ordinate represents a range of clear vision, i.e., a distance where nonuniformity in the compensated portion cannot be recognized.

In the experiments coated paper (product No.: HR101) manufactured by Canon Kabushiki Kaisha (hereinafter referred as Canon K.K.) is used as the medium to be recorded. One path recording on the coated paper is recorded by the ink-jet printer BJF850 manufactured by Canon K.K. The gray color is generated by mixing C, M, Y and Bk.

Intermediate gradation is generated by mixing three colors, C, M and Y, i.e. by a so-called process Bk and high gradation is generated by adding Bk and gradually extracting C, M and Y. A process for generating a gray color employing color inks and black ink is carried out by referring to a table corresponding to a selected gradation value.

From FIG. 33A it is understood that distances where the white streak cannot be recognized (i.e., range of clear vision) are different from the lightness of the compensated portion of b. From curves depicted in FIG. 33A it is deduced that distances where the nonuniformity such as the white streak and the like can not be recognized, indicate smaller values, when the lightness of the portion b nears to lightness of the portion a, i.e., around 51.

It is also deduced from FIG. 33A that when the lightness of the portion b is set within a range of the lightness of the portion a ±10, the compensation is effective. The digits ±10 correspond to ±20% of the lightness 51 of the portion a. Almost the same relations between two lightness values are obtained when the lightness of the portion a is varied.

Preferably when the lightness of the portion b is set within a range of ±10% of the lightness of the portion a, compensation effects are raised.

It is also understood that when the width of portion b is smaller, a slightly increased lightness (slightly brighter) of the portion b compared to that of the portion a makes the range of clear vision shorter. It is considered that this fact is caused due to dense color (lower lightness) at blotted and overlapped boundaries between portions of a and b.

Particularly since the gray color is formed by the above-mentioned process Bk, blotted areas are relatively spread.

In this case lightness of the white background of the medium is about 92.

Figure 33B:
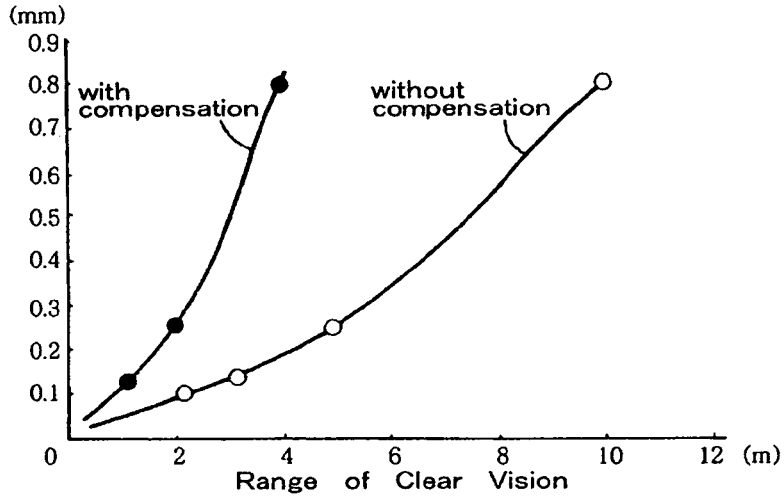
FIG. 33B is a graph showing a relation between distance of distinct vision and unrecognized defect width with and without compensation by minimum lightness (about 56) and FIG. 33C is an enlarged graph of a lowermost and leftmost portion of FIG. 33B.

FIG. 33B is the graph depicting relations between range of clear vision (axis of abscissa) and defect width (axis of ordinate) which cannot be recognized in a case of compensating with minimum lightness (about 56) in FIG. 33A and in a case without compensation.

Figure 33C:
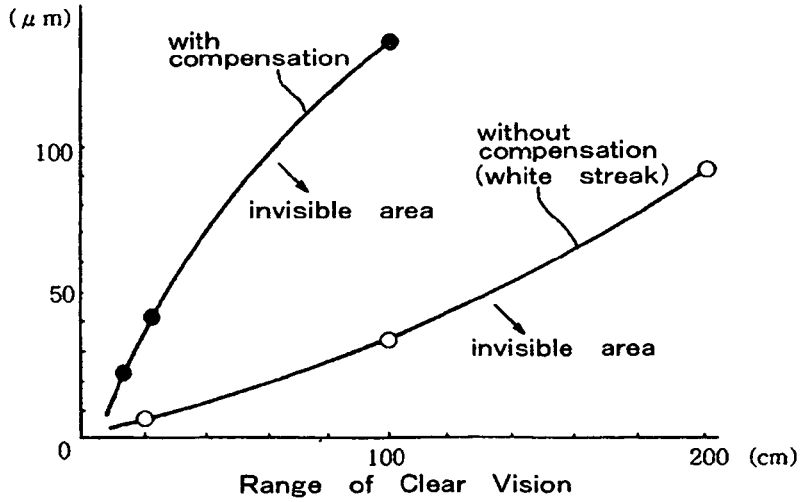

A lower portion around origin of coordinate (i.e., lower defect width) in FIG. 33B is enlarged and shown in FIG. 33C.

A recognizable boundary of the defect with width d is plotted in FIG. 33C as a curve with the symbol ○ (circle). This curve indicates that when the defect width is about 30 μm, the defect cannot be recognized with the boundary value of distance 100 cm and when the defect width is about 5 μm, the defect cannot be recognized with the boundary value of distance 20 cm. In other words, it is concluded that when the defect with about 30 μm width is observed apart from more than 100 cm, the defect cannot be recognized and when the defect with about 5 μm width is observed apart from more than 20 cm, the defect cannot be recognized.

In a case where the defect portion b is recorded with compensating gray color so as to set the lightness at a predetermined level, the unrecognizable defect with width d shows a curve with the symbol ● (painted circle) as plotted in FIG. 33C. This curve with painted circle indicates that when the defect with about 130 μm width is observed apart from more than 100 cm, the defect can be hardly recognized, and even when the defect with about 40 μm width is observed apart from more than around 20 cm, the defect can be hardly recognized. Consequently, when the defect is compensated with another color with the predetermined lightness, the defect portion is much less likely recognized than the case without compensation.

From the above-mentioned result, it is concluded that if the lightness of the portion b is set at a proper value and is compensated by another color, it is possible that the white streak will be less recognizable.

The gray color employed in the above-mentioned experiments is formed by mixing C, M, Y and/or Bk inks, i.e., by the so-called process Bk. When the defect portion b is compensated by a thinned Bk dot pattern, almost the same results are obtained as the gray color compensation.

Figure 34B:
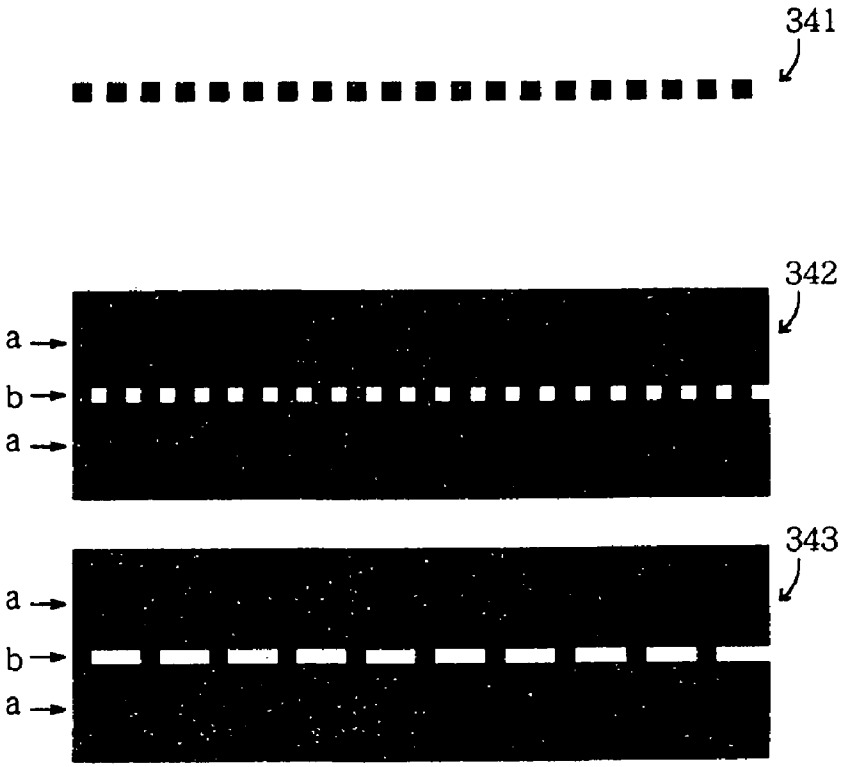
FIG. 34B is a drawing showing a compensation example of the defect portion b by the thinned Bk dot patterns.

An example to compensate the defect portion b by the thinned Bk dot pattern is shown in FIG. 34B. A reference numeral "341" in FIG. 34B is a thinned Bk dot pattern. Reference numerals "342" and "343" are examples of the compensated defect portion b by thinned Bk dot patterns.

Figure 34A:
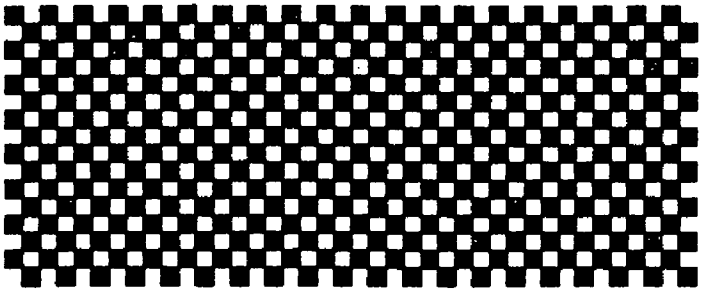
FIG. 34A is a drawing showing an enlarged thinned dot pattern 341 in FIG. 34B.

The compensated portion b (the thinned Bk dot pattern) bearing no nonuniformity, an enlarged pattern of which is shown in FIG. 34A, is formed and lightness of a predetermined area of the pattern is measured. When the measured lightness is compared with the lightness of the portion a, it is concluded that respective lightness values indicate close values to each other as indicated in the case by compensated gray color.

One of the reasons why Bk dot patterns are employed is that high duty recorded portions by other colors including secondary colors having low lightness can be matched to thinned Bk dot patterns, since the lightness of Bk dot per se is quite low.

Hereinafter a method of compensating a defect with width d smaller than 200 μm is explained in detail.

In the compensating method, one pixel with a resolution of 1200×1200 dpi is formed by using a recording head with a resolution of 1200 dpi from which an ink droplet of about 4 pl is ejected and impacted on a coated paper HR101 manufactured by Canon K.K.

A uniform gradation pattern is formed with C ink by adjusting an image to be recorded so as to obtain one non-eject status, two successive non-eject statuses, three successive non-eject statuses and ten successive eject statuses.

The non-eject portion is compensated with Bk ink dots.

As explained hereinafter, conditions on which the non-eject portion cannot be recognized as nonuniformity when observed from a certain distance are determined.

Figure 35A:
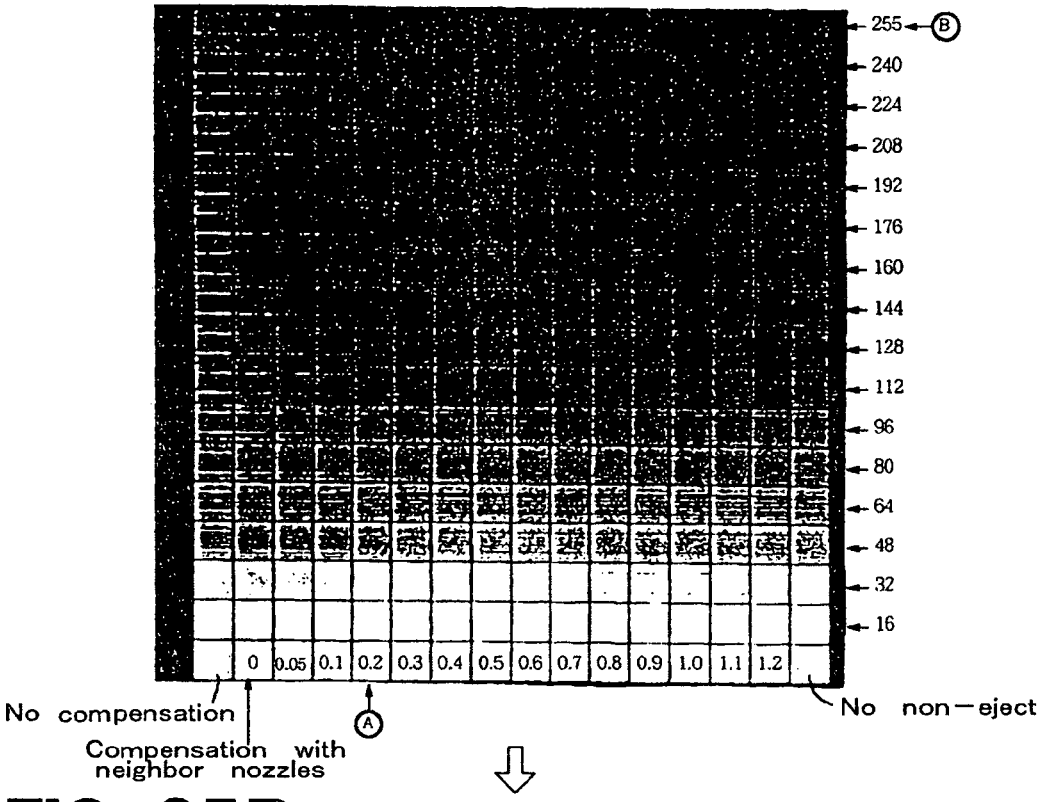
FIG. 35A is an example of a recorded pattern compensated by black ink dots from neighbor nozzles and FIG. 35B is a score table on non-uniformity of the recorded pattern in FIG. 35B.

In this method the pattern shown in FIG. 35A is recorded. Each grid is recorded so as to show a uniform gradation but so as to have non-eject portions Several non-eject portions are scatteringly formed in each grid.

In FIG. 35A, in a vertical direction, gradation expressed in 8 bit in each grid is varied from 0 to 255. And in a horizontal direction, a coefficient to determine gradation of compensating dots in each grid is varied from 0 to 1.2.

In the example shown in FIG. 35A, when a coefficient value at a position of encircled A in the horizontal direction is 0.2 and when a gradation value at a position of encircled B is 255, a calculated gradation of a compensating dot is 255×0.2=51.

Figure 35B:
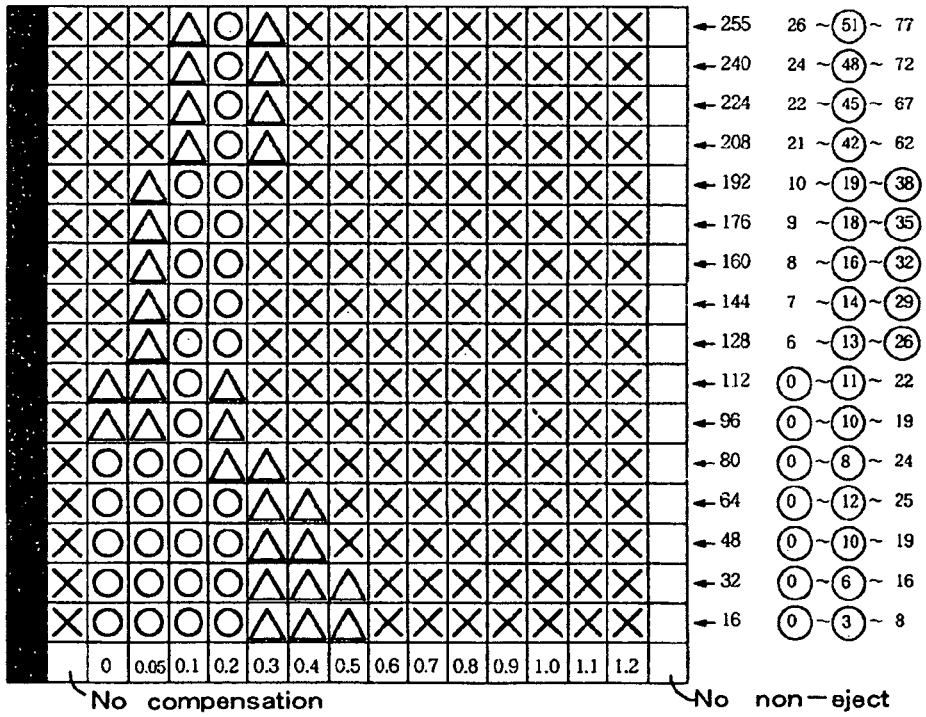

Since no nonuniformity is observed in a grid corresponding to the above-calculated position, it is marked with the symbol ○ as shown FIG. 35B. Grids that are difficult to judge whether nonuniformity is observed or not are marked with the symbol Δ. Grids where nonuniformity is observed are marked with the symbol x.

FIG. 35B is completed when the above-mentioned evaluation procedure is carried out repeatedly.

Figure 36:
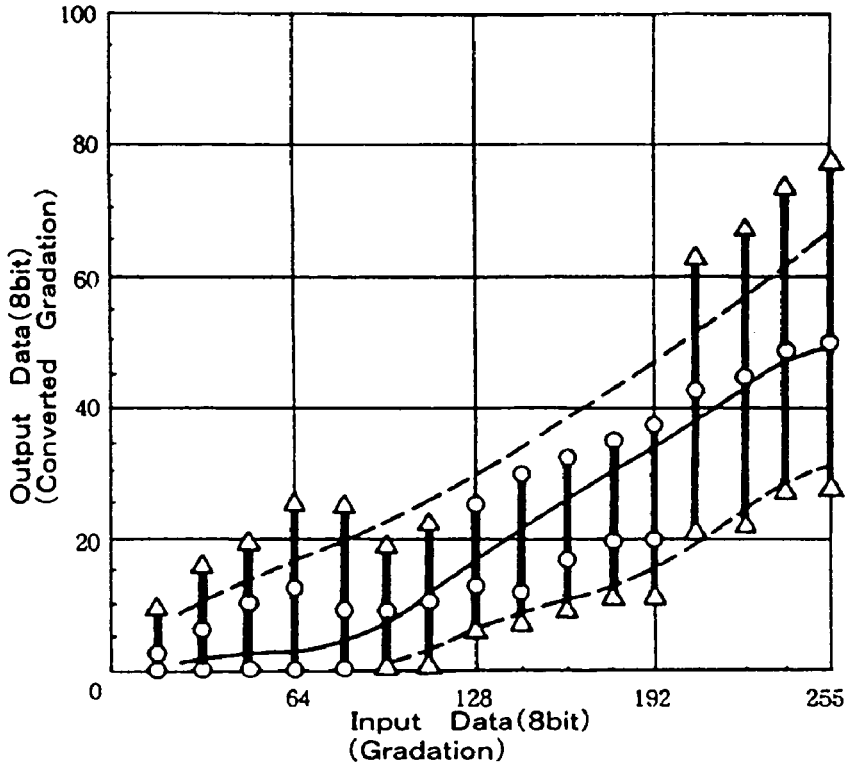
FIG. 36 is a graph based on the score table in FIG. 35B.

FIG. 36 is obtained based on the results in FIG. 35B.

In FIG. 36 results marked with the symbol ○ and with the symbol Δ are depicted, but results marked with the symbol x are omitted.

Actually a compensation curve depicted with a solid line in FIG. 36 is obtained based on a more finely divided grid pattern than the pattern shown in FIG. 35A.

An area formed by two broken line curves sandwiching the solid line curve, indicates the area where nonuniformity is inconspicuous.

Drawings shown in FIGS. 35A, 35B and 36 are examples of neighbor compensations by Bk carried out by raising multi-data of the next neighbor nozzles to a non-eject nozzle 1.5 times so that the number of dots from the next neighbor nozzles are raised 1.5 times.

Figure 37:
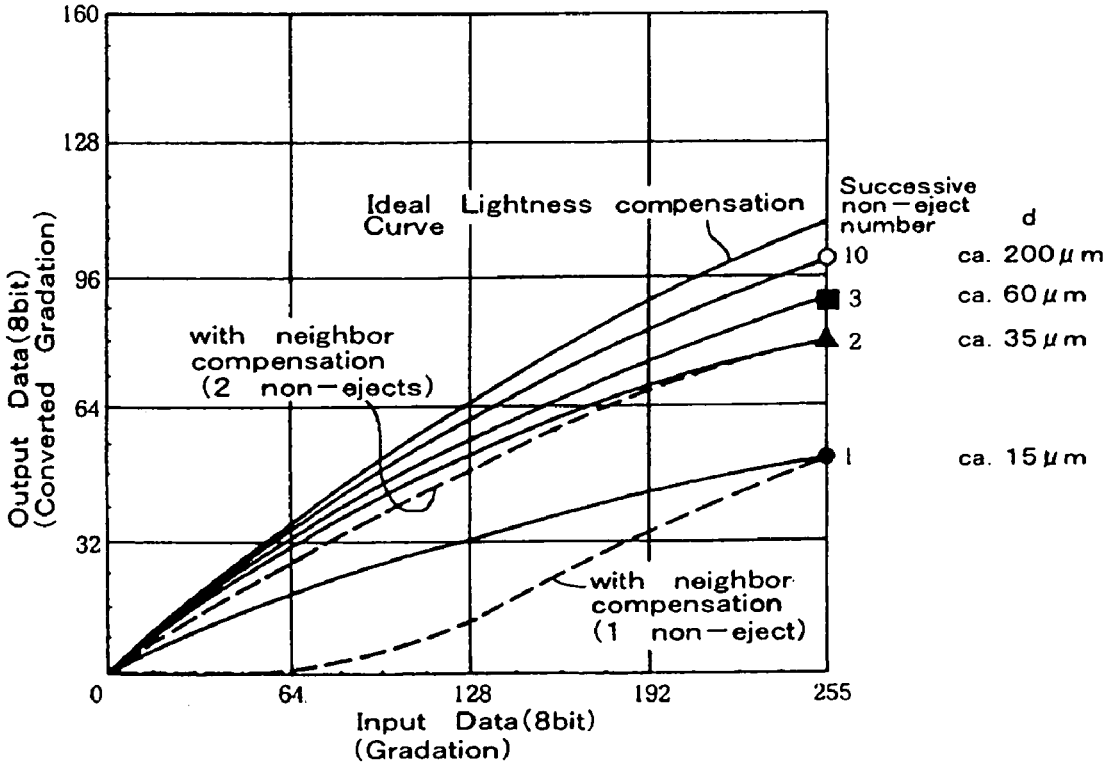
FIG. 37 is a graph showing compensation curves with/without neighbor compensations.

In the same way, compensation curves with/without neighbor compensations by Bk in respective cases of one non-eject nozzle, two successive non-eject-nozzles, three successive non-eject nozzles and ten successive non-eject nozzles, are shown in FIG. 37.

Figure 42:
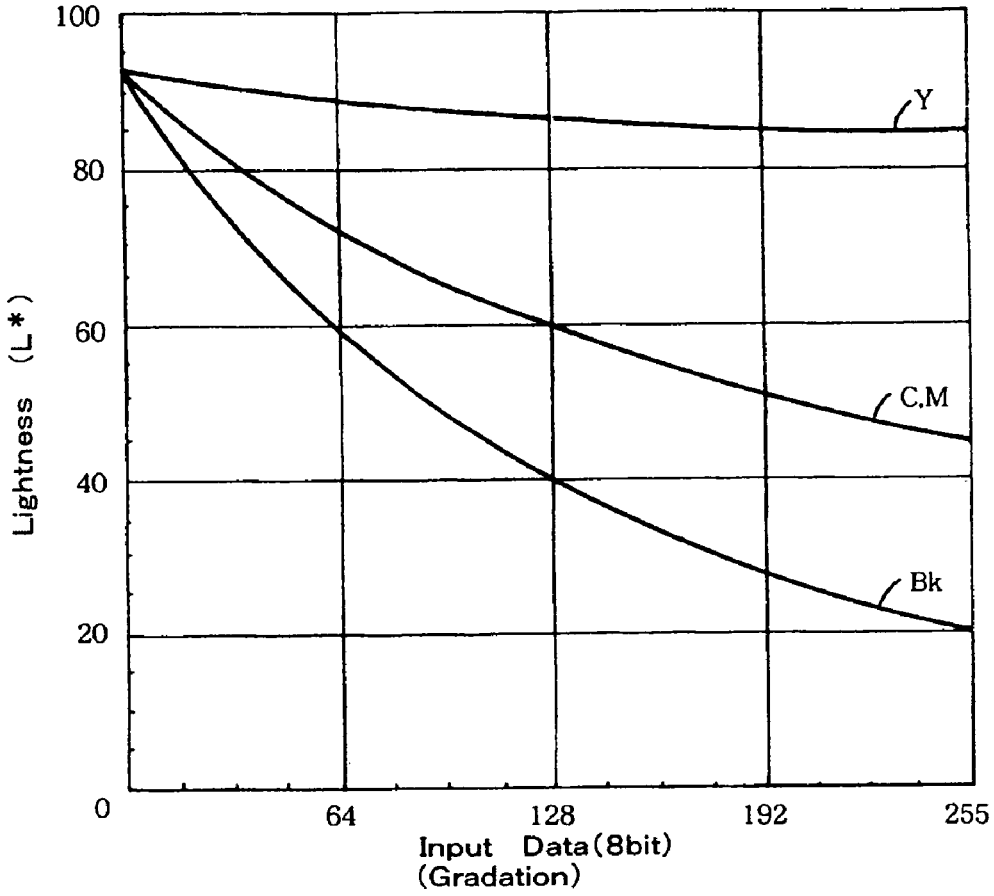
FIG. 42 is a graph illustrating curves showing relations between input multi-data and lightness L* of respective uniform color patterns.

The relation between lightness L* and multi-data with values from 0 to 255 in respective colors obtained from measured results on the same conditions mentioned above are plotted in FIG. 42.

In the figure, C and M show curves quite similar to each other.

An ideal compensation curve, obtained in the following way is also plotted in FIG. 37. An input data value of Bk indicating the same lightness as an input data of C is treated as an output data value against the input data value of C.

From FIG. 37, it is understood that compensation curves are close to the ideal compensation curve, as the number of successive non-eject ports are increased.

On the contrary, compensation curves show easier gradient as the number of successive non-eject ports are decreased.

Reasons for the above-mentioned observed facts are explained below.

The number of compensation dots for compensating defect portions per unit area is thought to be constant. However, since the defect ratio to one pixel is smaller as the number of non-eject nozzles are decreased, namely, the number of compensation dots are decreased, the compensation curve shows easier gradient.

Figure 39:
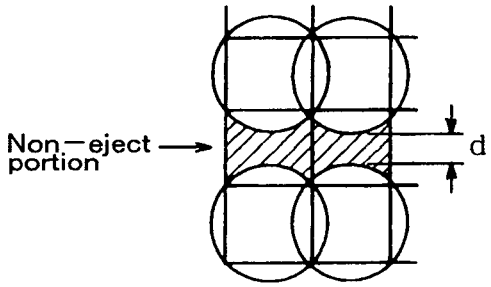
FIG. 39 is an explanatory drawing illustrating that the defect width d caused by one non-eject nozzle is narrower than the width of one pixel.

As shown in FIG. 39, since a recorded dot by the ink-jet shows an almost circular dot, a defect width d is smaller than a width of one pixel.

For example, in the case of 1200 dpi by the present embodiment, a width of one pixel is about 21 μm, while the actual defect width is about 15 μm.

Measured defect widths of two, three and ten successive non-eject nozzles are respectively 35 μm, 60 μm and 200 μm.

These measured results are also plotted in FIG. 37.

Consequently it is deduced that virtual defect widths are not proportional to the number of non-eject nozzles.

Figure 40:
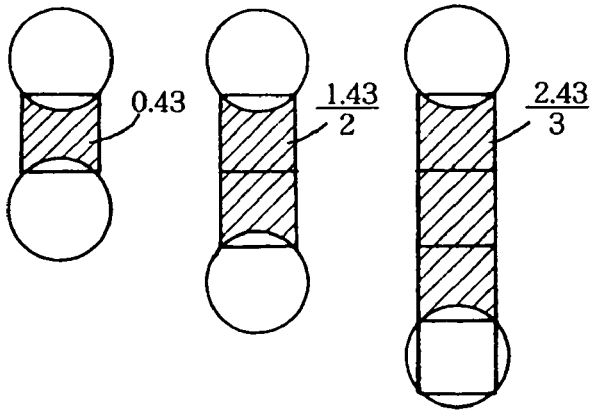
FIG. 40 is an explanatory drawing illustrating several calculated examples of defect areas.

In order to deduce the virtual defects widths, defect areas depicted in FIG. 40 are calculated.

When the calculated defect areas are divided by an area of one pixel, non-eject area rates are obtained.

Figure 43:
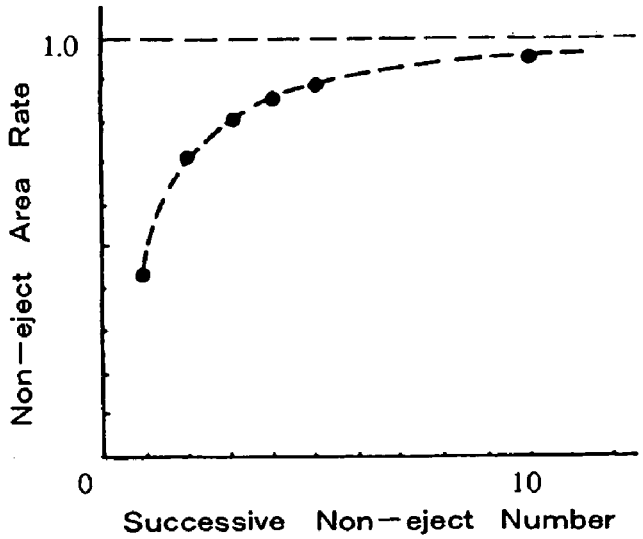
FIG. 43 is a graph showing a relation between the number of successive non-eject nozzles and the non-eject area rate.

Non-eject area rates against the number of successive non-eject nozzles are plotted in FIG. 43.

As the number of non-eject nozzles increases, the non-eject area rate is converged to 1.

Figure 38:
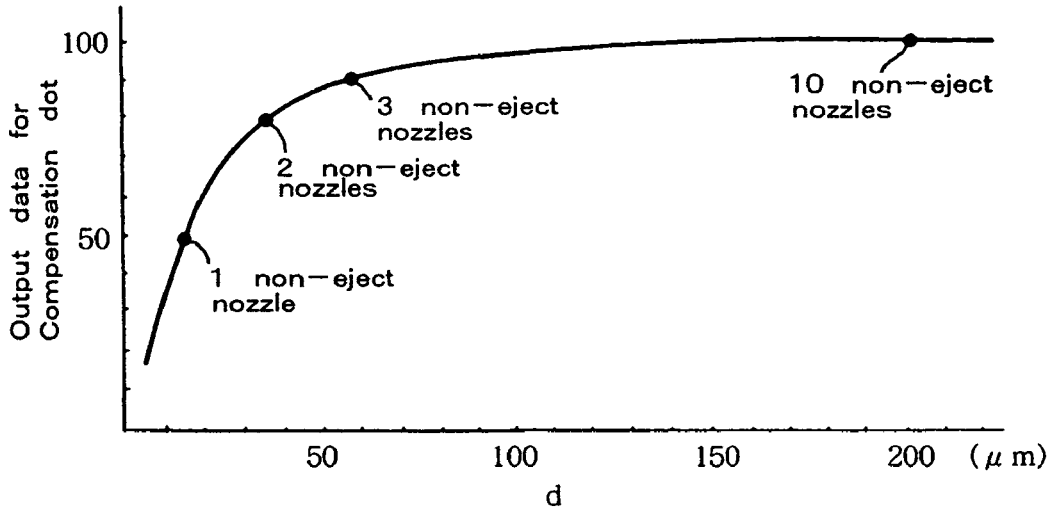
FIG. 38 is a graph showing a relation between the defect width d and output data when input data in FIG. 37 indicate 255.

Output data values of the compensation dot at input data value 255 (max) of FIG. 37 are plotted against the defect width d as shown in FIG. 38.

Figure 41:
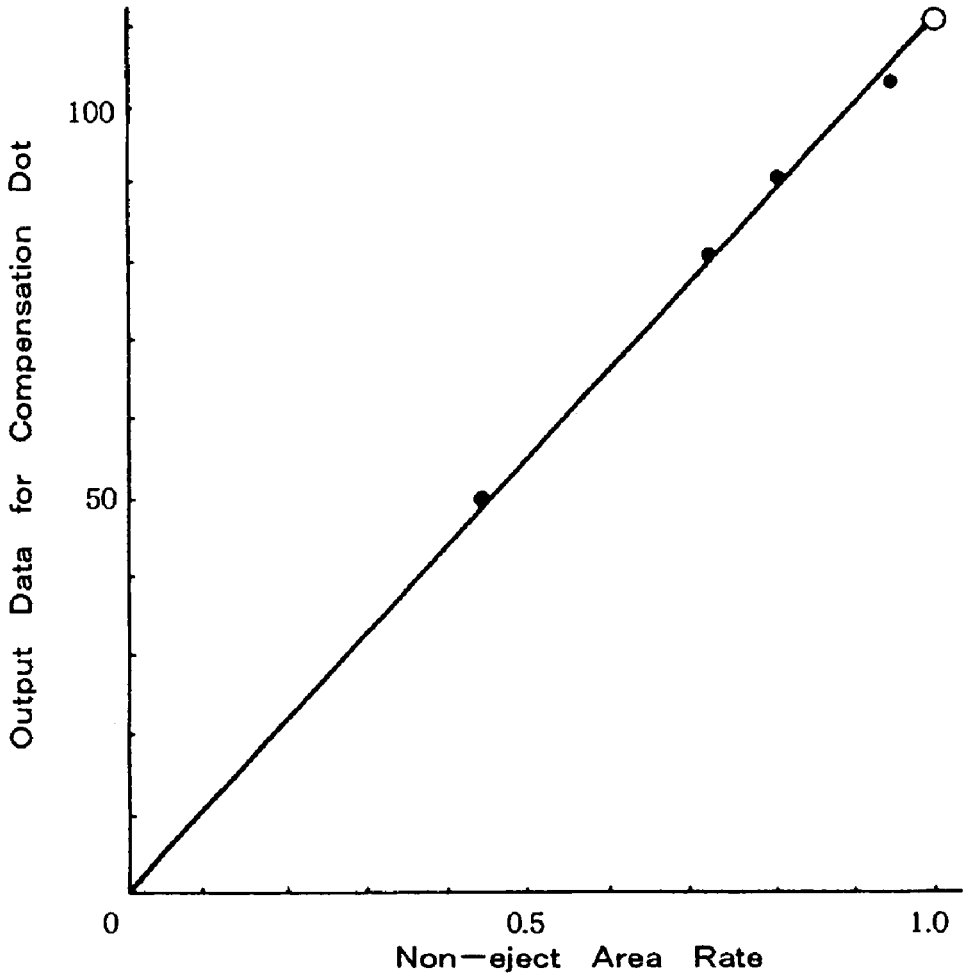
FIG. 41 is a graph showing a relation between a non-eject area rate and output data for compensation when input data is 255.

Output data values of the compensation dot corresponding to the above-mentioned non-eject area rates at input data value 255 (max) are plotted against the defect width d as shown in FIG. 41.

From a graph in FIG. 41, it is understood that the non-eject area rate is almost proportional to the output data values of compensation dots when the input data value is 255 (max).

The non-eject area rate means a defect ratio against one pixel. Since the defect ratio against one pixel indicates a smaller value as the number of non-eject nozzles is decreased as understood from FIG. 43, output data of the compensation dot indicates smaller value.

Deducing the results mentioned above, since the defect ratio against one pixel can be calculated from dot profiles such as the number of successive non-eject nozzles, the dot diameter and the like, the compensation curves can be calculated.

Namely, compensation curves are obtained, when the ideal compensation curve is multiplied by the defect ratio against one pixel.

Alternatively, the evaluation chart in FIG. 35B and the compensation curve in FIG. 36 can be produced by the following procedure. A similar test pattern to the pattern in FIG. 35A is recorded by a printing apparatus. The recorded pattern is read by a scanner or sensors and the like arranged in the printing apparatus. The read pattern is evaluated so as to form an evaluation chart and a compensation curve respectively similar to FIG. 35B and FIG. 36. In this procedure, sensors are defocused so as to adjust their sensitivity at the same level as human eyes and grids where white streaks or black streaks are distinctively recognized are removed and remaining intermediate grids are selected so as to form a compensation curve similar to FIG. 36.

Non-eject portions to be recorded by M ink are also compensated by Bk in the same way explained in detail for compensating non-eject portions to be recorded by C ink.

Compensations against secondary colors such as red (R), green (G), blue (B) and so on by utilizing the above-mentioned method are explained.

For example in a compensation case by R, since R is obtained by mixing M and Y, non-eject M portions can be compensated by Bk, which is an easy treatment, even when some portions of M are in non-eject statuses. While Y is recorded according to its data.

Compensating Bk data determined to make the non-eject portion to be recorded by M inconspicuous is mixed with Y data and recorded. In this case, lightness of a color of mixed M and Y does not coincide with lightness of a color of mixed Bk, as a compensation dot for M, and Y. However, a difference between two lightness values is within ±10%, which is in a range practically employable without difficulties.

As explained above, it is proved that white streaks due to non-eject statuses can be compensated by another color having near lightness to that of the original color and can be hardly recognized as streak nonuniformity provided non-eject widths are sufficiently narrow against range of clear vision.

Based on the results of the experiments explained above, when lightness of the compensating color is set in ±20% range of lightness of the original color, nonuniformity is improved at least before compensation (black streaks do not become more conspicuous). Preferably, if the lightness of the compensating color is set in ±10% range of lightness of the original color, the compensated results are remarkably improved.

Since lightness of Bk dots compensating a portion b shown in FIGS. 34A and 34B is lower than lightness of dots forming a portion "a", the number of Bk dots is smaller than the number of dots to be recorded by the original color.

When lightness of the portion b is set in ±20% range of lightness of the portion a, the number of compensation dots does not exceeds the number of dots to be compensated.

The number of dots per unit area is calculated in the following way.

When the number of dots to be compensated is defined as "LC", the number of compensation dots is defined as "C", the number of compensation dots coinciding with lightness of corresponding image data to be recorded by dots to be compensated is defined as "M", the number of compensation dots coinciding with lightness +20% of corresponding image data to be recorded by dots to be compensated is defined as "MPP", the number of compensation dots coinciding with lightness +10% of corresponding image data to be recorded by dots to be compensated is defined as "MP", the number of compensation dots coinciding with lightness −20% of corresponding image data to be recorded by dots to be compensated is defined as "MMM" and the number of compensation dots coinciding with lightness −10% of corresponding image data to be recorded by dots to be compensated is defined as "MM", it is preferable to set the defined C so as to satisfy relations expressed by the following equations.

| | |
|---|---|
| $C < LC$ | Equation 1 |
| $M < LC$ | Equation 2 |
| $MPP < C < MMM$ | Equation 3-1 |

Further it is more preferable to set the defined C so as to satisfy the following equation in addition to equation 1 and equation 2.

| | |
|---|---|
| $MP < C < MM$ | Equation 3-2 |

This compensation method is applied to, for example, Bk compensations dots against cyan and magenta dots to be compensated and cyan compensation dots against thin cyan dots to be compensated.

Compensation examples by Bk dots are explained above, but compensations by other color dots can be carried out in the same way.

<Embodiments of Lightness Compensation by Using Bk Ink>

Hereinafter, a method to compensate non-eject nozzles by Bk dots is described.

This method is based on adjusted image data such that lightness of image uniformly recorded by dots for compensation falls into a predetermined difference range from lightness of image to be recorded uniformly by non-eject nozzles.

It is preferable to compensate by a color with similar chromaticity to that of a color to be compensated. For example non-eject nozzles arranged in a head for cyan ink can be compensated with magenta or black by matching lightness. However, boundaries of compensated portions are relatively conspicuous when compensated with magenta due to a difference in chromaticity between cyan and magenta. Therefore non-eject cyan nozzles are desirably compensated by Bk dots, if chromaticity is taken into consideration. Original data on lightness of C nozzles are converted to data on lightness of Bk nozzles so as to keep converted data within a predetermined lightness difference, and converted data are added to original data of Bk nozzles and outputted afterward.

A conversion example from C to Bk is carried out as follows.

Figure 5:
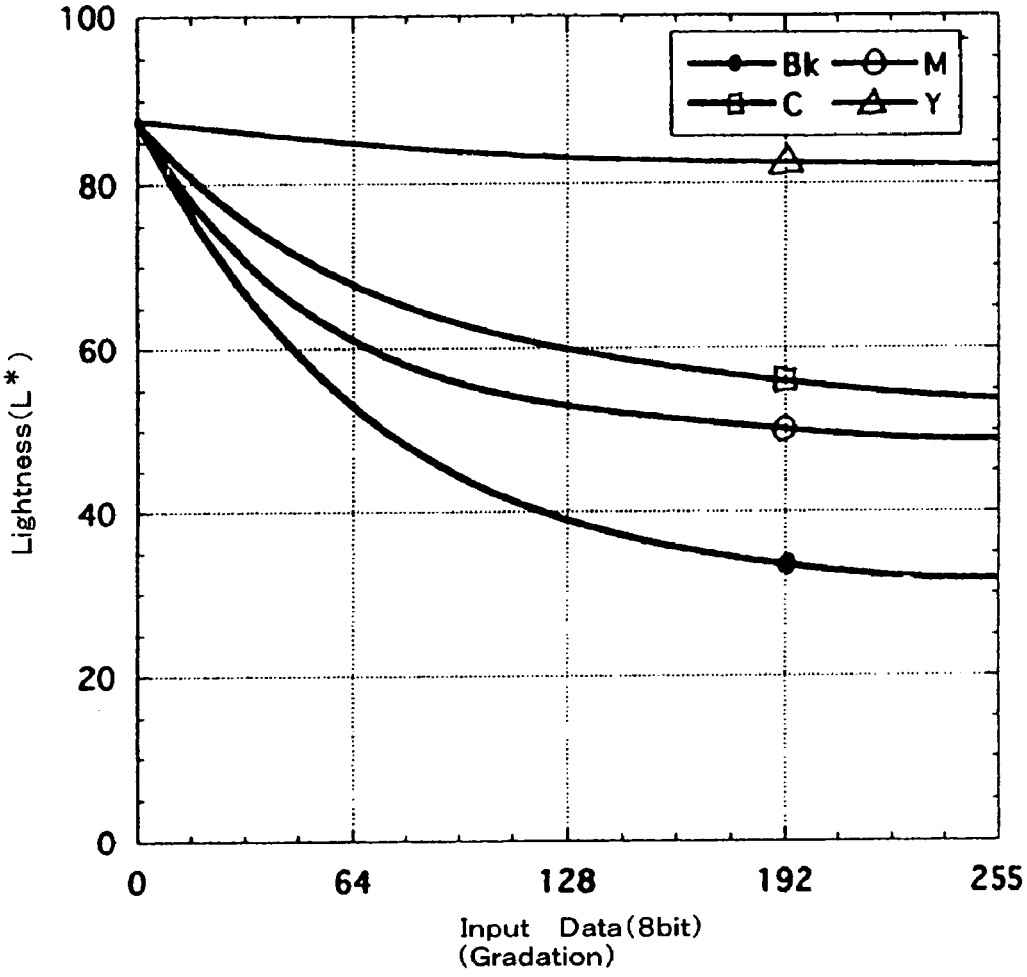
FIG. 5 is a graph showing a relation between input data and lightness (output data).

FIG. 5 is the graph showing relations between input data and lightness in respective inks recorded on a coated paper with a low blotting rate. The axis of abscissa represents input data in respective colors and the axis of ordinate represents lightness in respective colors. FIG. 5 shows when input data of C is 192, lightness indicates about 56. While in order to obtain the same lightness value 56 in Bk, input data should be 56.

Consequently, from FIG. 5, it is concluded that when data on non-eject cyan nozzles are 192, converted data for black ink indicate 56.

Figure 6:
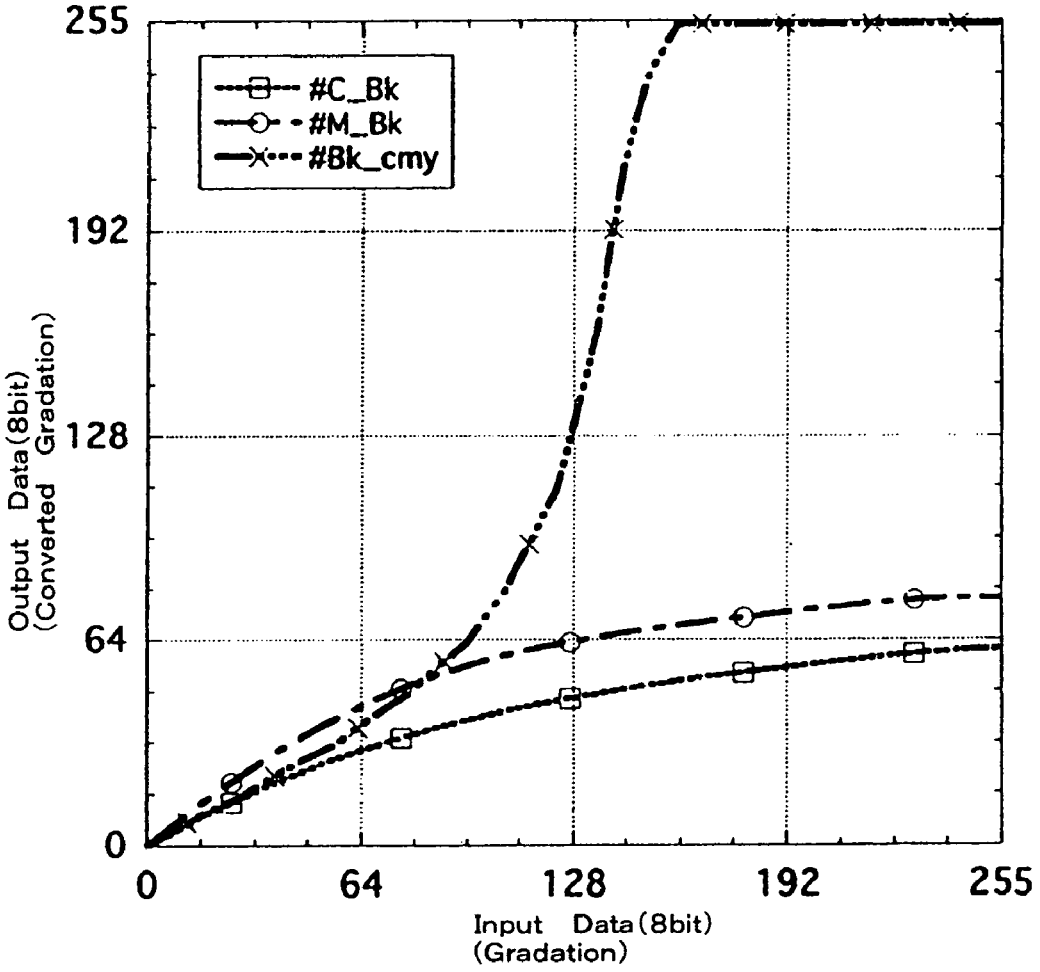
FIG. 6 is a graph showing conversion examples when recording defects are compensated by different colors.

In this way relations between C, M and Bk used for compensating are plotted in FIG. 6. FIG. 6 is the graph showing relations between input data corresponding to non-eject nozzles and converted output data for compensation recording. In this drawing a curve designated by #C_Bk shows a relation compensating cyan by black ink and another curve designated by #M_Bk shows a relation compensating magenta by Bk ink. When defect portions caused by non-eject cyan or magenta are compensated by black ink, a table as shown in FIG. 6 is used so that influence by non-eject is reduced by outputting added converted Bk data corresponding to defect portions to the original Bk data. The lightness of Y against paper does not vary so much even when its input data is varied. In other words, since yellow is a quiet color, it is not necessary to compensate by another color.

A curve designated by #Bk_cmy in FIG. 6 shows a relation compensating Bk by three colors C, M and Y. Non-eject portions by Bk can be compensated by using C, M and Y. Since relations shown in FIGS. 5 and 6 are different according to recording media, inks, ink quantity to be ejected and so forth, it is necessary to prepare various kinds of conversion tables in accordance with employed systems.

<Compensation by Head Shading>

Hereinafter a method to make defect portions inconspicuous by a head shading treatment is explained. The head shading is a technique to compensate density nonuniformity mainly generated by fluctuating ejecting properties of respective plurality of nozzles, and to make density nonuniformity inconspicuous by determining correcting data for respective nozzles for minimizing density nonuniformity. More specifically, a test recorded image is read by a scanner and correction data are determined for raising densities of corresponding nozzles to low density portions in the read image or lowering densities of corresponding nozzles to high density portions in the read image, thus making densities uniform.

By performing the head shading treatment, corrections are carried out against areas corresponding to non-eject portions (defect portions) in the original image such that recording duties of at least neighboring peripheral pixels around the areas are raised, thus non-eject portions are made inconspicuous.

The head shading is the method for removing nonuniformity by modifying output γ values (which will be explained in detail below) of respective nozzles according to density nonuniformity in a read test pattern recorded by the recording head. In an ordinary resolution range from 400 dpi to 600 dpi, read data on density nonuniformity are corrected in such a manner that an average density of a present nozzle and its neighbor nozzles is considered as the corrected density of the present nozzle.

Since recorded densities corresponding to neighbor nozzles to the non-eject nozzle are lowered, data of neighbor nozzles are corrected to raise in their densities by the head shading treatment.

The corrected dot number in a surrounding area of a pixel corresponding to the non-eject nozzle is raised to a similar dot number to a case without non-eject nozzle, and as a result nonuniformity cannot be recognized.

FIGS. 4A to 4E are schematic drawings showing data correcting manners of neighbor nozzles to the non-eject nozzle by the head shading treatment.

Four dots are recorded in respective grids shown in FIGS. 4A to 4D, when recorded with 100% duty. On the other hand, in respective grids shown in FIG. 3E two dots are recorded, when recorded with 100% recording duty. Nozzles are arrayed in vertical directions in these respective drawings. An arrow "A" in respective drawings indicates a position not recorded due to the non-eject nozzle.

Figure 4A:
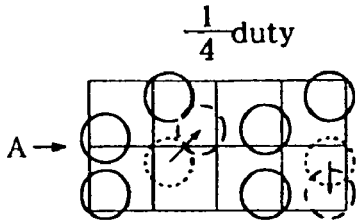
FIGS. 4A, 4B, 4C, 4D, 4E and 4F are schematic drawings for explaining non-eject dots and compensation ways in a case of an image formed by one dot per pixel.

FIG. 4A shows a schematic image to be recorded with ¼ recording duty, where data on neighbor nozzles to the non-eject nozzle are corrected to raise their density so that the dot number to be recorded are increased by the shading treatment. FIG. 4E shows a schematic image to be recorded with ⅛ recording duty. In recording with low recording duties as mentioned above, streaks caused by non-eject nozzles are inconspicuous so that there are no significant differences between observed densities of corrected dot images and densities of images recorded by a normal recording head due to the increased dot number recorded by neighbor nozzles.

Figure 3A:
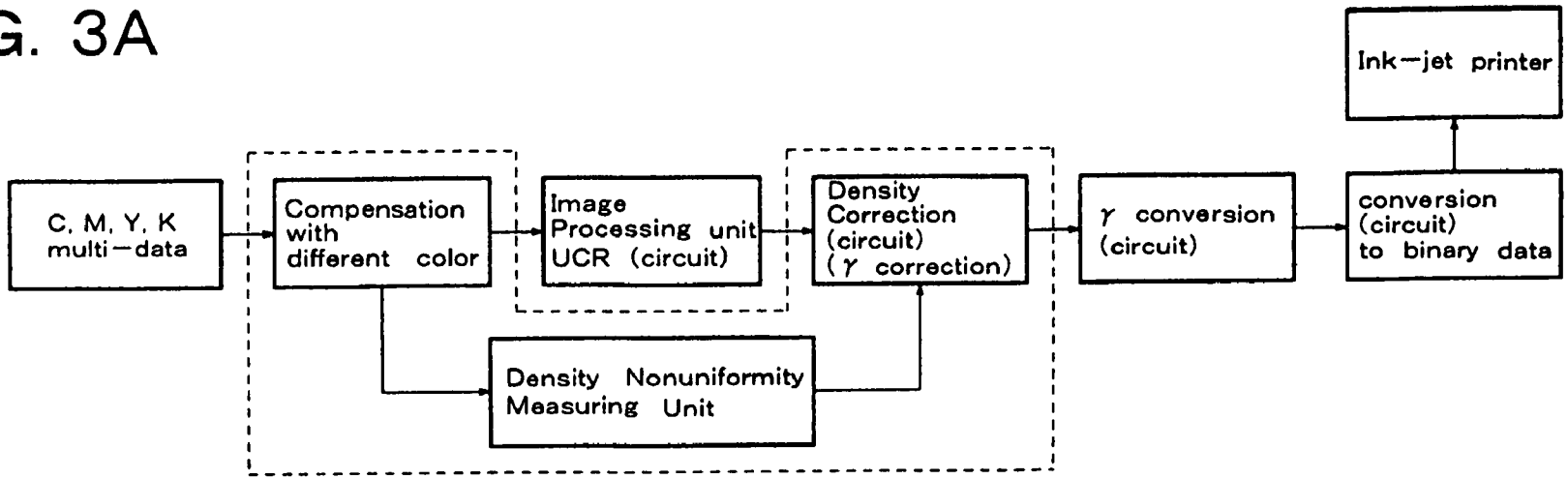
FIGS. 3A and 3B are block diagrams showing arrangements of compensation means.
Figure 3B:
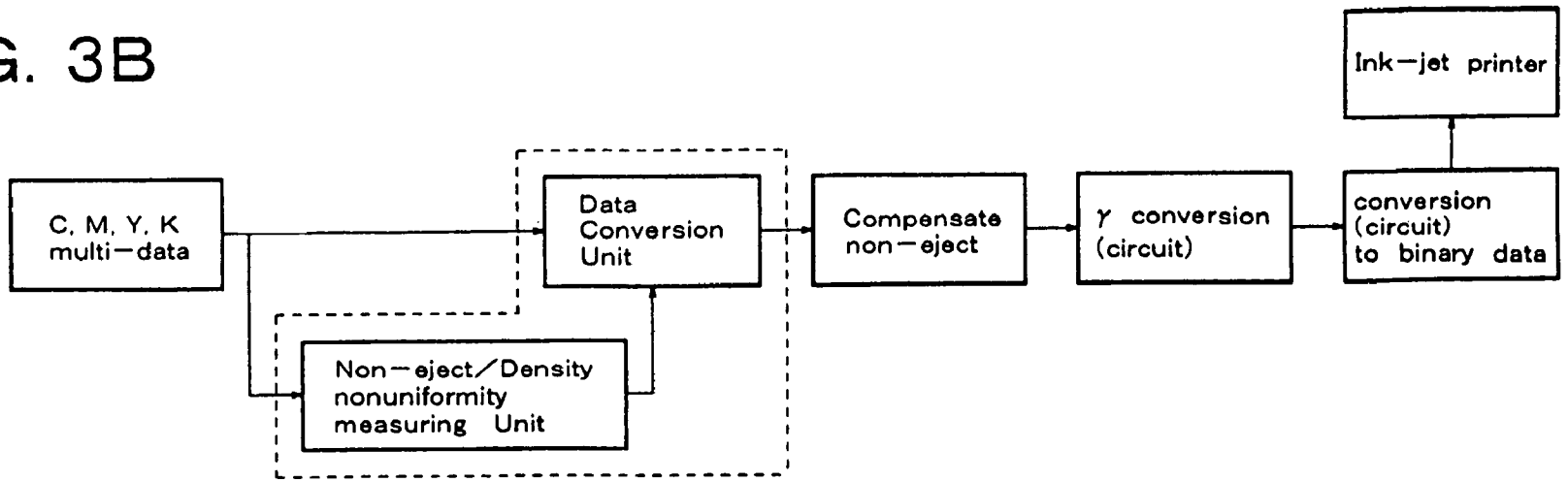
Figure 4B:
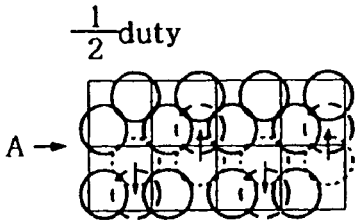
Figure 4C:
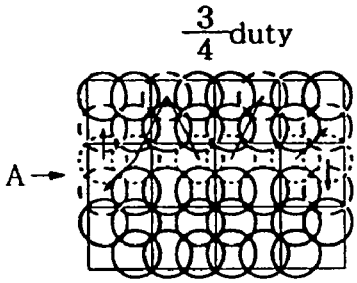
Figure 4D:
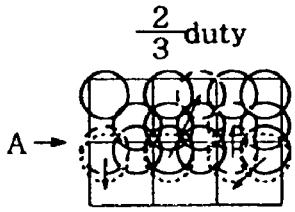
Figure 4E:
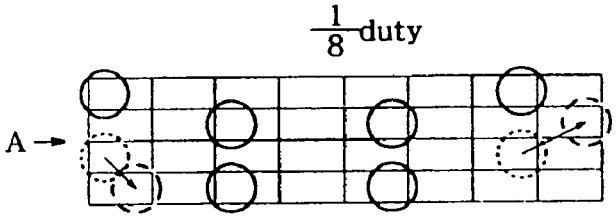

FIG. 4B shows a schematic image to be recorded with ½ (50%) recording duty and FIG. 4C shows a schematic image to be recorded with ¾ (75%) recording duty. Since the recording duty of the image shown in FIG. 3C is set high, density corresponding to the non-eject nozzle cannot be reproduced only by neighbor nozzles, so that data on second neighbor nozzles are corrected to raise their density. As shown in FIGS. 4B and 4C, as dot densities to be recorded are raised, defect portions corresponding to non-eject nozzles (indicated by the arrow A) become gradually conspicuous as streaks.

Therefore the above-mentioned head shading treatment can effectively suppress density drop caused by defects in images due to non-eject statuses, when image areas with low duties are treated.

Figure 4F:
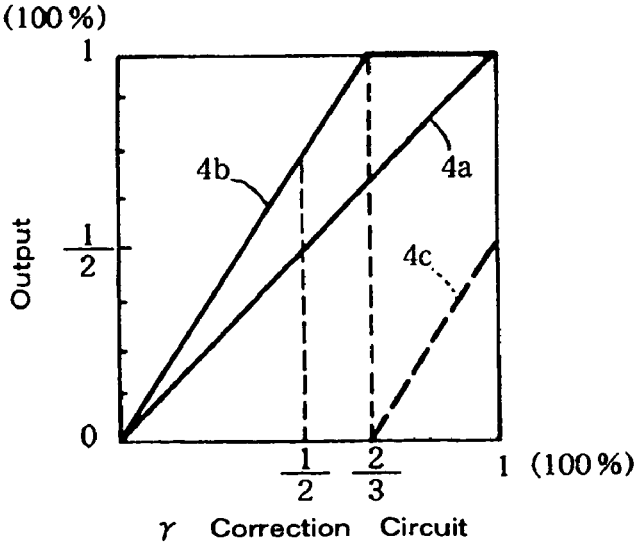

FIG. 4F shows an example of γ correction to neighbor nozzles to the non-eject nozzle judged by the head shading treatment. Reference character "4*a*" is a gradient with no correction. Reference character "4*b*" is a gradient to raise the density 1.5 times by the γ correction. γ corrections against neighbor nozzles of the non-eject nozzle can be executed so as to raise the densities 1.5 times at the maximum.

A reference character "4*c*" in FIG. 4F is a compensation example by other colors, which is explained below.

As described above, in low recording duties the dot number in the vicinity of the non-eject nozzle is almost similar to that of the surrounding area when the uniform pattern is recorded so that nonuniformity can hardly be conspicuous.

<Combination of Lightness Compensation with Head Shading Treatment>

Here the above-mentioned two compensation methods are employed together. Namely non-eject portions are compensated by using another color and neighbor nozzles of the non-eject portions.

Hereinafter a more effective arrangement to make defects in images caused by non-eject nozzles is explained by combining the method to compensate the defects with another color by adjusting its lightness with the head shading treatment.

It is preferable to adjust properly the above-mentioned respective compensation method in order to optimize the combined compensation method. As described above, in areas with low recording duties, the dot number in the vicinity of the pixel corresponding to the non-eject nozzle and neighbor nozzles is almost similar to the dot number without non-eject nozzle, the vicinity of the pixel cannot be recognized as nonuniformity by the head shading treatment (see FIG. 4A and FIG. 4E).

However, in the head shading treatment when a solid area image is recorded with a high recording duty, portions corresponding to non-eject nozzles tend to be white streaks and recognized as streaky nonuniformity. Therefore when recorded with low recording duty, non-eject portions should be compensated by the head shading treatment and when recorded with high recording duty non-eject portions should be additionally compensated by another color so that defect portions in the recorded image due to non-eject nozzles are suppressed regardless of differences of recording duties.

FIG. 4F shows a compensation example combining the head shading treatment with the compensation with another color. Neighbor nozzles to the non-eject nozzle are compensated according to the line 4*b* in FIG. 4F, and if a recording duty is high, defect portions corresponding to the non-eject nozzle are compensated by another color. The line 4*b* shows a γ compensation which raises image density up to 1.5 times. When the recording duty of image data exceeds ⅔ (67%), image data corresponding to another color are generated according to a line 4*c* in FIG. 4F. Thus, when the recording duty is lower than ⅔, defect portions caused by non-eject are made inconspicuous by raising image density in areas corresponding to neighbor nozzles of the non-eject nozzle, and when the recording duty is higher than ⅔, compensation recording can be executed by another color so as to match lightness of non-eject portions to that of another color.

Hereinafter, based on compensation by the above-mentioned methods, a compensation procedure by an ink-jet recording apparatus is explained in detail.

The present invention can be executed by a printer having a function of a scanner or a printer capable of inputting density nonuniformity and read data on the pattern for measuring non-eject nozzles. Here, however, the compensation procedure is explained in the case of a color copy machine equipped with an ink-jet method capable of reading and recording color images.

First Embodiment

<Method Combined with Lightness Compensation with Bk Compensation>

The present embodiment is intended to compensate non-eject nozzles by using another color, particularly black (Bk) against cyan (C) and magenta (M) so as to match lightness of another color to that of the non-eject color based on image data corresponding to non-eject nozzles.

Hereinafter the preferred embodiment is explained by referring to drawings.

Figure 13:
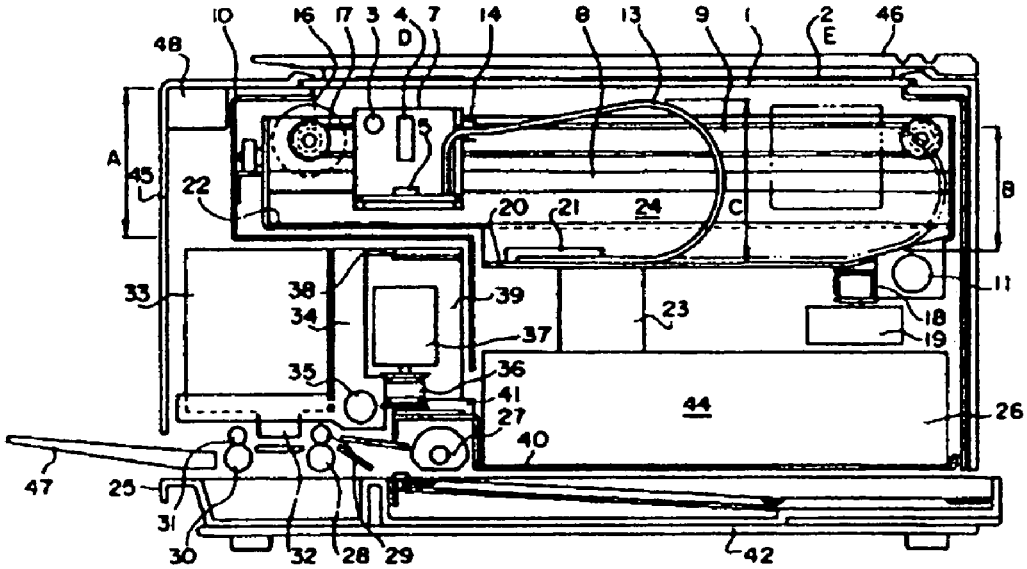
FIG. 13 is a side sectional view showing an arrangement of a color copying machine as an example of the ink-jet recording apparatus of the present invention.

FIG. 13 is the side sectional view illustrating an arrangement of the color copying machine employing the inkjet recording apparatus of the present embodiment.

This color copying machine is constituted by an image reading and image processing unit (hereinafter referred to as a reader unit 24) and a printer unit 44. The reader unit 24 reads an image script 2 mounted on a script glass 1 via a CCD line sensor having three color filters, R, G and B, while being scanned. The read image is processed by an image processing circuit and the processed image is recorded on a paper or other recording media (hereinafter also referred as recording paper) by printer unit 44, namely by four color ink-jet heads, cyan (C), magenta (M), yellow (Y) and black (Bk).

Image data from outside can be inputted, and inputted data are processed by the image processing unit and recorded by printer unit 44.

Hereinafter, operational movements of the apparatus are explained in detail.

The reader unit 24 is comprised of members or portions 1 to 23 and the printer unit is comprised of members or portions 25 to 43. A left upper side in FIG. 13 corresponds to a front face of the machine, which an operator faces.

The printer unit 44 is equipped with an ink-jet head (hereinafter also referred as a recording head) 32, which executes recording operations by ejecting inks. In the ink-jet head 32, for example, 128 nozzles for ejecting inks are arrayed and eject ports are formed at ejecting sides of nozzles. 128 eject ports are arranged in a predetermined direction (in a sub-scanning direction, which will be explained below) with a pixel pitch of 63.5 μm so that the recording head can record a width of 8.128 mm. Consequently when the recording paper is recorded, once a feeding operation (feeding in the sub-direction) of the recording paper is stopped, the recording head 32 is moved in a direction perpendicular to the plane of FIG. 13 while the feeding operation is stopped. After the recording head records a desired distance with the width of 8.128 mm, the recording paper is fed by 8.128 mm and stopped and, then the recording head starts recording. Thus, feeding operations and recording operations are alternately repeated. The recording direction is called a main scanning direction and the paper feeding direction is called the sub-scanning direction. In the constitution by the present embodiment, the main scanning direction corresponds to the direction perpendicular to the plane of FIG. 13 and the sub-scanning direction corresponds to the right/left directions in FIG. 13.

The reader unit 24 repeats reading the script image 2 by the width of 8.128 mm in response to the movements of the printer unit 44. Here a reading direction is called a main scanning direction and a feeding direction of the script image for the next reading is called a sub-scanning direction. In the present constitution, the main direction corresponds to the right/left directions in FIG. 13 and the sub-scanning direction corresponds to the perpendicular direction to the plane of FIG. 13.

Hereinafter, operational movements of the reader unit are explained.

The script image 2 on the script mount glass 1 is irradiated by a lamp 3 mounted on a main scanning carriage 7, and the irradiated image is directed to CCD line sensor 5 (photo sensor) via a lens array 4. The main scanning carriage 7 is fitted to a main scanning rail 8 mounted on a sub-scanning unit 9 so as to slide along the rail. The main scanning carriage 7 is connected to a main scanning belt 17 via a connecting member (not shown) so that it moves in the left/right directions in FIG. 13 by rotating a main scanning motor 16 for executing main scanning operations.

The sub-scanning unit 9 is fitted to a sub-scanning rail 11 fixed to an optical frame 10 so as to slide along the rail. The sub-scanning unit 9 is connected to a sub-scanning belt 18 via a connecting member (not shown) so that it moves in the perpendicular direction to the plane of FIG. 13 by rotating a sub-scanning motor 19 for executing main scanning operations.

Image signals read by CCD line sensor 5 are transmitted to the sub-scanning unit 9 via a flexible signal cable 13 capable of being bent in a loop. One end of the signal cable 13 is held (clamped) by a holder 14 on the main scanning carriage 7. Another end of the signal cable is fixed to a bottom surface 20 of the sub-scanning unit by a member 21 and is connected to a sub-scanning signal cable 23 which connects the sub-scanning unit 9 to an electrical component unit 26 of the printer unit 44. The signal cable unit 13 follows movements of the main scanning carriage 7 and the sub-scanning signal cable 23 follows movements of the sub-scanning unit 9.

Figure 14:
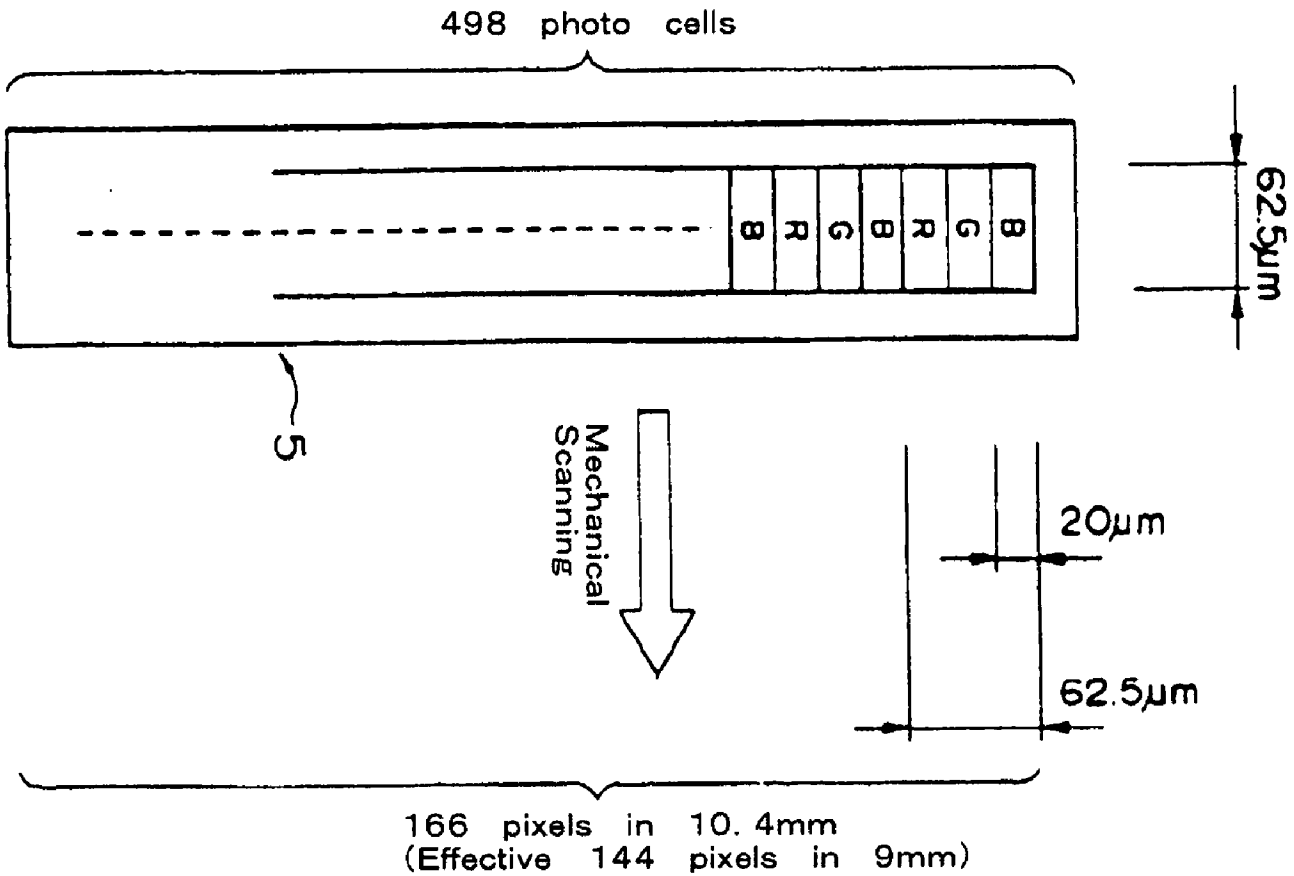
FIG. 14 is a drawing for explaining a CCD line sensor (photo sensor) in detail.

FIG. 14 is a detailed drawing of CCD line sensor 5 by the present embodiment. The line sensor 5 consists of 498 photo cells arrayed in a line and can read actually 166 pixels since each pixel requires three color elements, R, G and B. Among 166 pixels, the effective number of pixels is 144, which occupies a width of about 9 mm.

Hereinafter operational movements of the printer unit 44 are explained.

In FIG. 13, recording paper sent from a recording paper cassette 25 one by one by to a supply roller 27 driven by a power source (not shown) is recorded by a recording head 32 between two pairs of rollers, 28, 29 and 30, 31. The recording head is monolithically formed with an ink tank 33 and demountably mounted on a printer main scanning carriage 34. The printer main scanning carriage 34 is fitted to a printer main scanning rail 35 so as to slide along the rail.

Further, since the printer main scanning carriage 34 is connected to a main scanning belt 36 via a connecting member (not shown), the carriage is moved in directions perpendicular to the plane of FIG. 13 by rotating a main scanning motor 37 so that the main scanning is executed.

The printer main scanning carriage 34 has an arm member 38, to which a signal cable 39 for transmitting signals to the recording head 32 is fixed. Another end of the signal cable 39 is fixed to a printer intermediate plate 40 by a member 41 and further connected to the electric component unit 26. The printer signal cable 39 follows movements of the printer main scanning carriage 34 and is arranged such that the cable does not contact with the optical frame arranged above.

Figure 26:
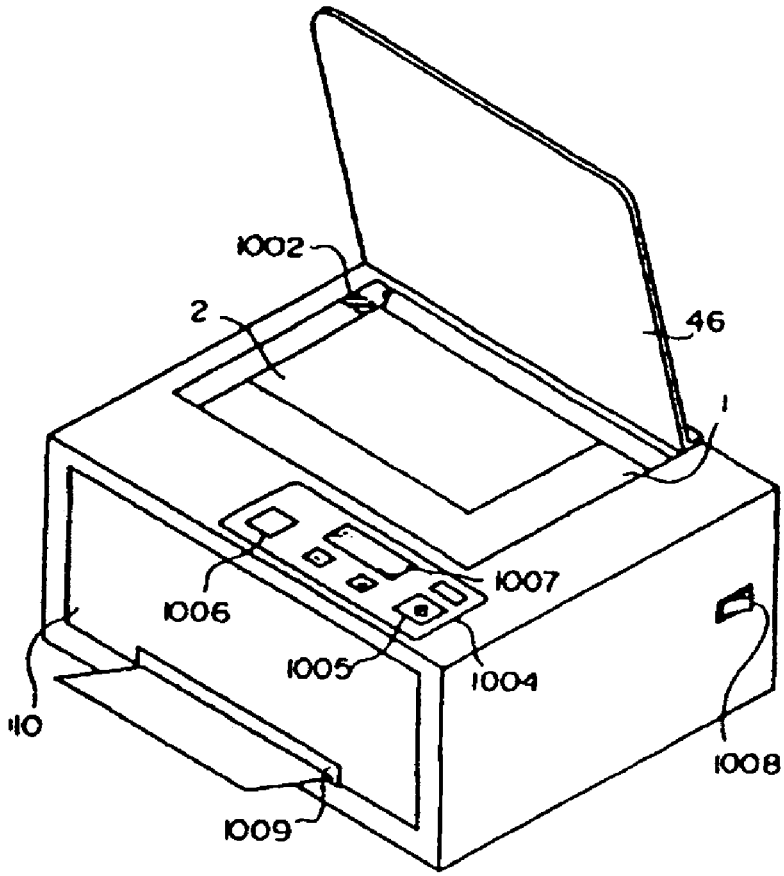
FIG. 26 is a perspective outline view of the main body of an ink-jet recording apparatus.

The sub-scanning of the printer unit 44 is executed by rotating the two pairs of rollers 28, 29 and 30, 31 driven by the power source (not shown) so that the recording paper is fed by 8.128 mm. A reference numeral "42" is a bottom plate of the printer unit 44. A reference numeral "45" is an outer casing. A reference numeral "46" is a pressure plate for pressing the image script against the image script mounting glass 1. A reference numeral "1009" is a paper discharging opening (see FIG. 26), a reference numeral "47" is a discharged paper tray and a reference numeral "48" is an electrical component unit 48 for operating the copy machine.

Figure 15:
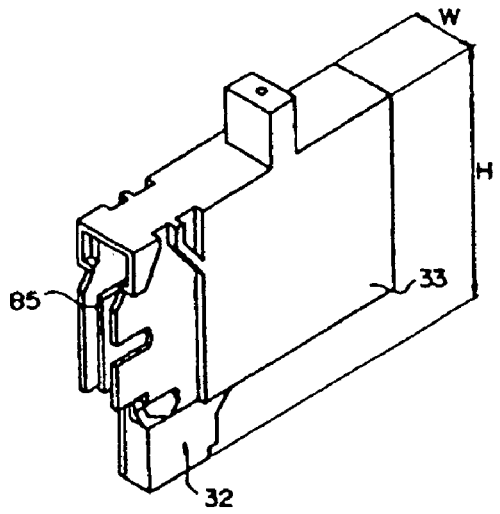
FIG. 15 is a perspective outline view of an ink-jet cartridge.
Figure 16:
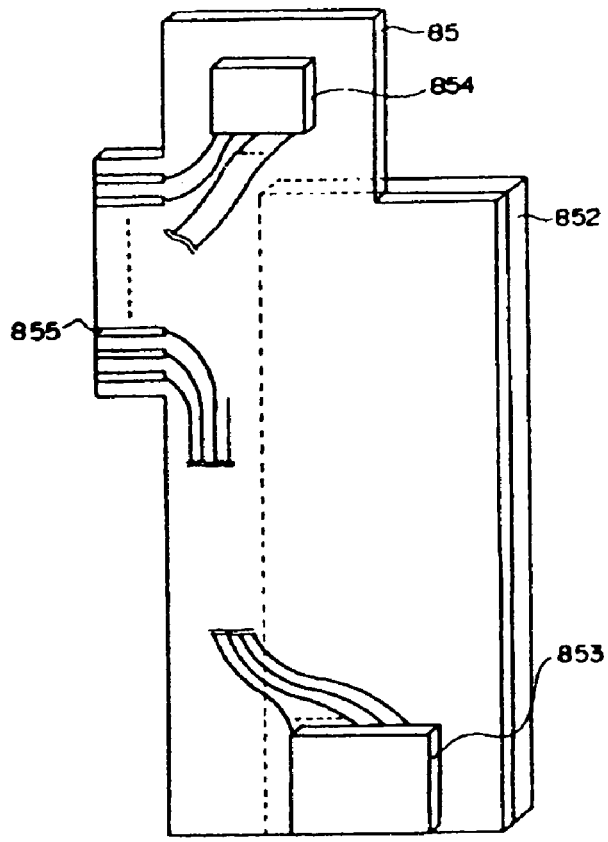
FIG. 16 is a perspective view showing a printed circuit board 85 in detail.

FIG. 15 is the perspective view illustrating an external appearance of an ink cartridge arranged in the printer unit 44 of the present embodiment. FIG. 16 is the perspective view illustrating the printed circuit board 85 shown in FIG. 15 in detail.

In FIG. 16, a reference numeral "85" is the print circuit board. A reference numeral "852" is an aluminum radiator plate. A reference numeral "853" is a heater board consisting of a matrix of heating elements and diodes. A reference numeral "854" is a memory means where information on respective nozzles is stored. For the memory means, a non-volatile memory such as an EEPROM and the like are employable in accordance with situations.

In the present embodiment, information whether respective nozzles are non-eject nozzles or not is stored, but it is possible to store other information such as density nonuniformity and the like.

A reference numeral "855" is a contact electrode connected to the printer unit of the copying machine. Arrayed nozzle groups are not shown in FIGS. 15 and 16.

Figure 17A:
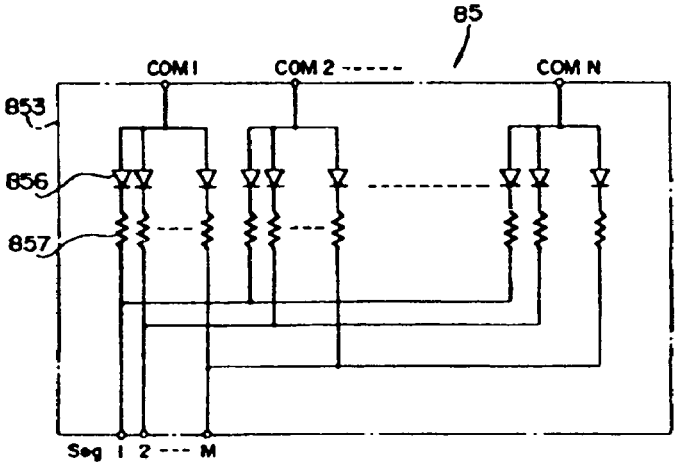
FIGS. 17A and 17B are drawings showing main circuit components of the printed circuit board 85.
Figure 17B:
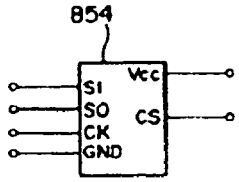
Figure 18:
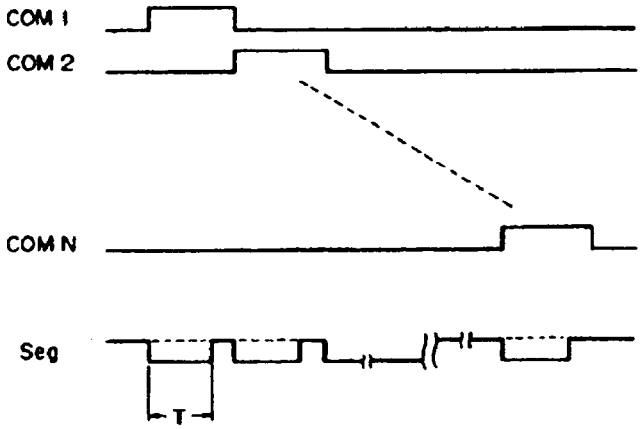
FIG. 18 is an explanatory drawing showing an example of time sharing driving chart for heating elements 857.

When the recording head is mounted to the printer unit of the copying machine, the printer unit reads information on non-eject nozzles from the recording head 32 and controls the recording head based on the read information so as to improve density nonuniformity. Thus, good image quality can be maintained FIGS. 17A and 17B show arrangement examples of main portions of a circuit on the printed circuit board 85 shown in FIG. 16. FIG. 17A shows a circuit arrangement of the heater board 853, which consists of an N×M matrix structure where respective heating elements 857 and respective diodes 856 for preventing rounded electric current are connected to each other in series. These heating elements 857 are allocated into N blocks and each block consists of M heating elements. Respective blocks are activated one after another according to a time sharing schedule as shown in FIG. 18. Quantities of energy to activate respective blocks are controlled by varying applied pulse widths (T) to the segment side (in FIG. 17A referred as Seg).

FIG. 17B shows an example of the EEPROM shown in FIG. 16. In the present embodiment, information on non-eject nozzles is stored in the EEPROM and outputted to an image processing unit of the copying machine in response to request signals (address signals) D1 from the copying machine via serial transmission.

Figure 21:
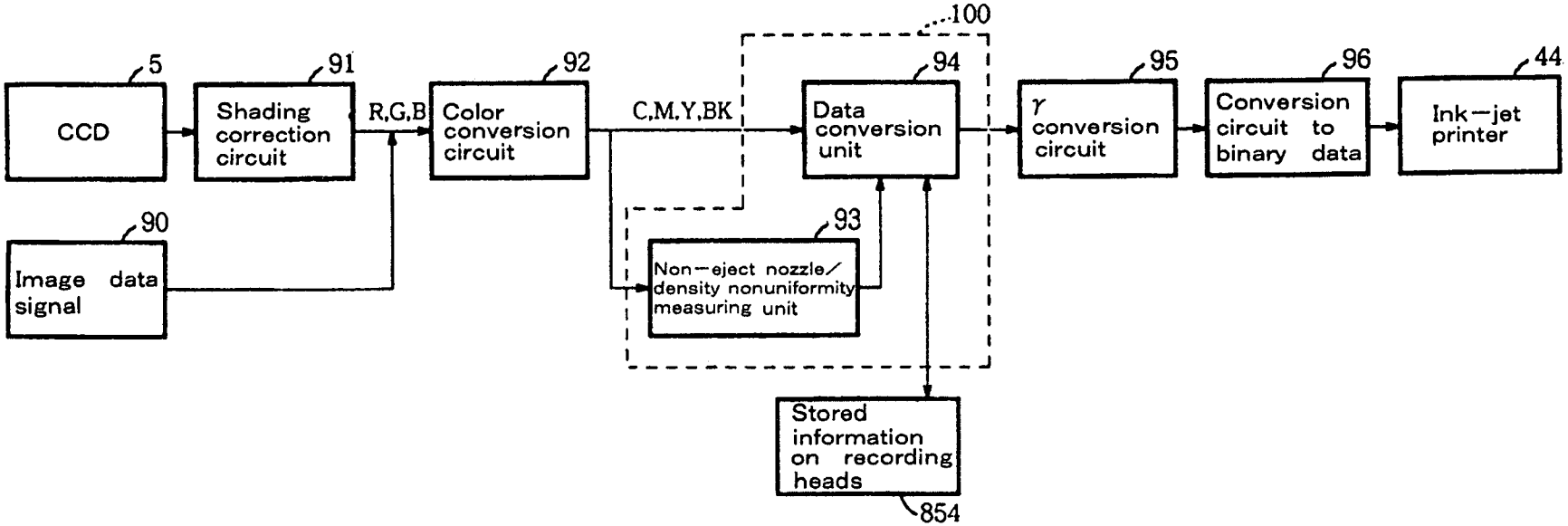
FIG. 21 is a block diagram showing an arrangement of an image processing unit of the present embodiment.

An example of the constitution of the image processing unit in the present embodiment is shown in FIG. 21.

In FIG. 21, sensor sensitivities of image signals read by the CCD sensor 5, as one of solid state image sensors, are corrected by a shading correction circuit 91. Corrected three primary colors of light, R (Red), G (Green) and B (Blue) are converted to colors for recording, C (cyan), M (Magenta), Y (Yellow) and Bk (Black) by a color conversion circuit 92.

Usually the color conversion is executed by utilizing a three dimensional LUT (Look Up Table), but such is not limited to the LUT. It is also applicable to colors for recording comprising low density LC (Light Cyan), LM (Light Magenta) and the like in addition to C, M, Y and Bk.

Image data acquired outside can be directly inputted to the color conversion circuit 92 and be processed there.

C, M, Y and Bk signals converted from RGB signals are inputted to a data conversion unit 94. Inputted signals are converted as mentioned below by utilizing the information on non-eject nozzles stored in the memory means arranged in the ink-jet recording head or information acquired by calculation based on measured data of non-eject nozzles, and supplied to a y conversion circuit 95. Properties on respective nozzles used here are stored in a memory of the data conversion unit 94.

The γ conversion circuit 95 stores several staged functions, for example, as shown in FIG. 18 for calculating output data from input data. Stored functions are properly selected based on density balances in respective colors and color taste of users. These functions are also determined based on properties of inks and recording papers. The γ conversion circuit 95 can be incorporated into the color conversion circuit 92. Output data from the γ conversion circuit are transmitted to a conversion to binary data circuit 96.

In the present embodiment, an error diffusion method (ED) is employed for converting transmitted data to binary data.

Outputted data from the conversion circuit 96 to binary data 96 are transmitted to the printer unit and recorded by the recording head 32.

The present embodiment utilizes the conversion circuit to binary data for outputting image data, but is not limited to this conversion circuit. For example a conversion circuit to tertiary data for utilizing large/small dots or a conversion circuit to n+1th data for utilizing 0 to n dots can be also selected depending on various outputting methods.

Hereinafter a non-eject nozzle/density nonuniformity measuring unit 93 and a data conversion unit 94, which constitute a data processing unit 100, are explained.

Figure 23:
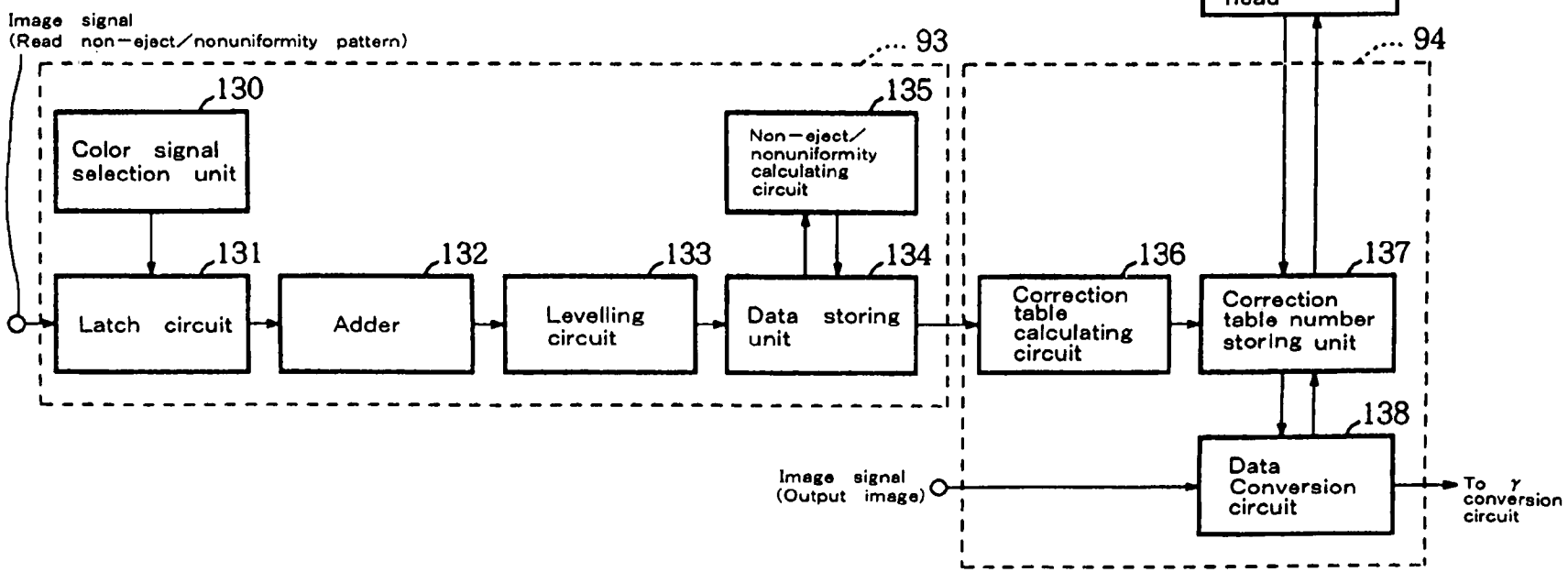
FIG. 23 is a block diagram showing an arrangement of a main portion of a data processing unit 100 for explaining its functions.

FIG. 23 is the block diagram showing a constitution of main portions of the data processing unit 100, where portions surrounded by broken lines are respectively the non-eject nozzle/density nonuniformity measuring unit 93 and the data conversion unit 94.

To begin with, detailed functions of the non-eject nozzle/density nonuniformity measuring unit 93 are explained.

In this unit, if information on non-eject nozzles is required to be renewed, operations for printing the non-eject/nonuniformity pattern, for reading printed pattern and for data processing are executed. If information on non-eject/nonuniformity is not required to be renewed, the above-mentioned operations can be omitted.

In the present embodiment, corrections on density nonuniformity are not executed, but the non-eject nozzle/density nonuniformity measuring unit 93 can acquire the information on density nonuniformity. However, the acquired information is used in other embodiments, and operations for acquiring the information will also be explained.

When the information on non-eject nozzles is renewed, a recovery operation of the recording head is executed prior to printing the non-eject/nonuniformity pattern for reading. The recovery operation consisting of a series of operations for removing ink adhered to the recording head 31, for removing bubbles by sucking ink from nozzles and for cooling head heaters, is very desirable as a preparing operation for printing the non-eject/nonuniformity pattern for reading on best conditions.

Figure 27:
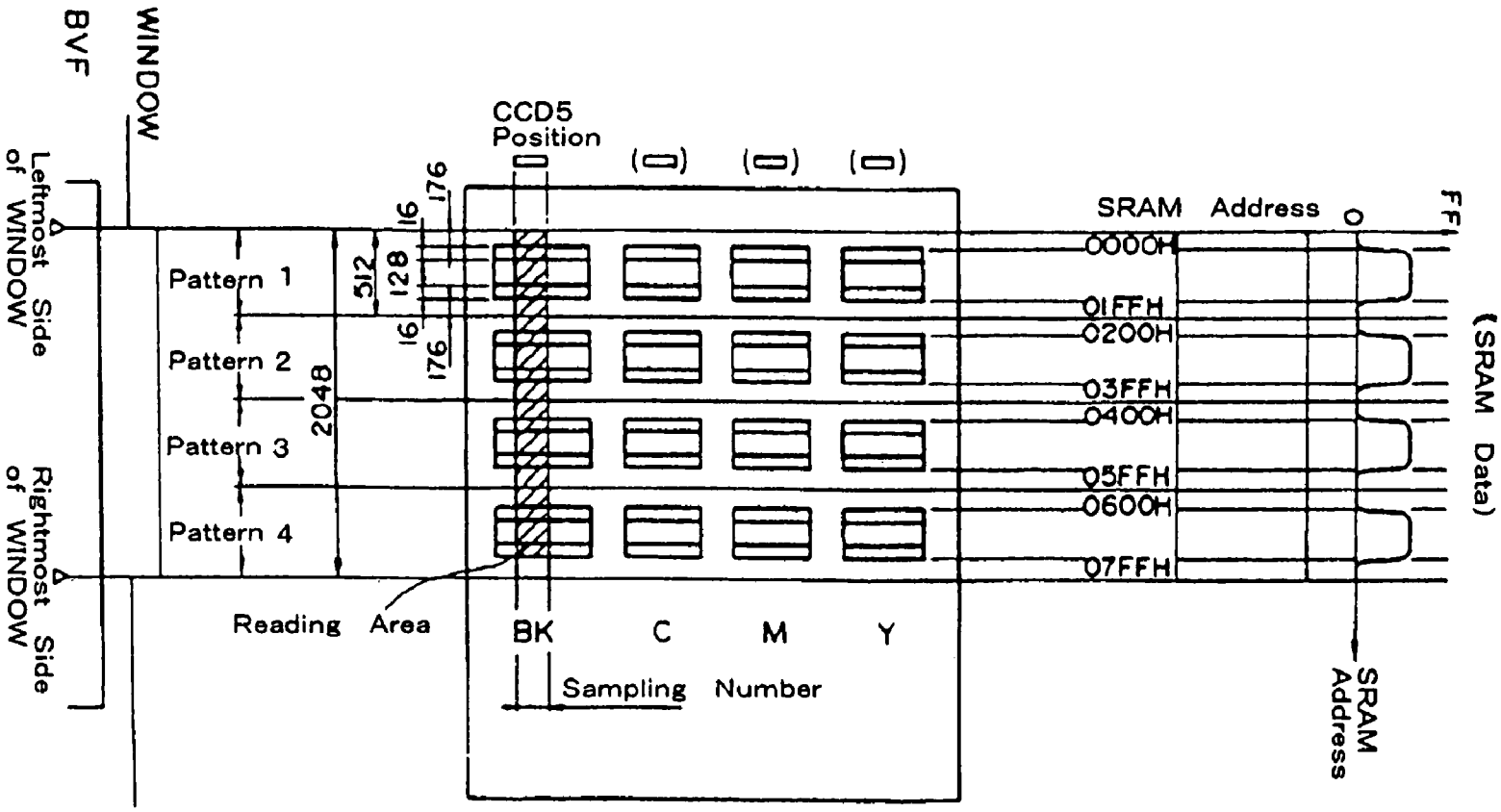
FIG. 27 is an explanatory drawing showing recorded output status of a nonuniformity pattern for reading.

Then the non-eject/nonuniformity pattern for reading shown in FIG. 27 is outputted as a recorded pattern. In the recorded pattern, four rows of respective color blocks are recorded at 50% half tone in a vertical direction in FIG. 27, and as a result 16 blocks are recorded in total. The patterns are recorded at predetermined positions on the recording paper. Each block consists of 3 lines of recording where the first and third lines are recorded by using uppermost and lowermost 16 nozzles, respectively, and the second line is recorded by using 128 nozzles; consequently, each recorded block at the half tone has a width corresponding to 160 nozzles. Reasons for recording each block with the width corresponding to 160 nozzles are as follows.

Figure 28:
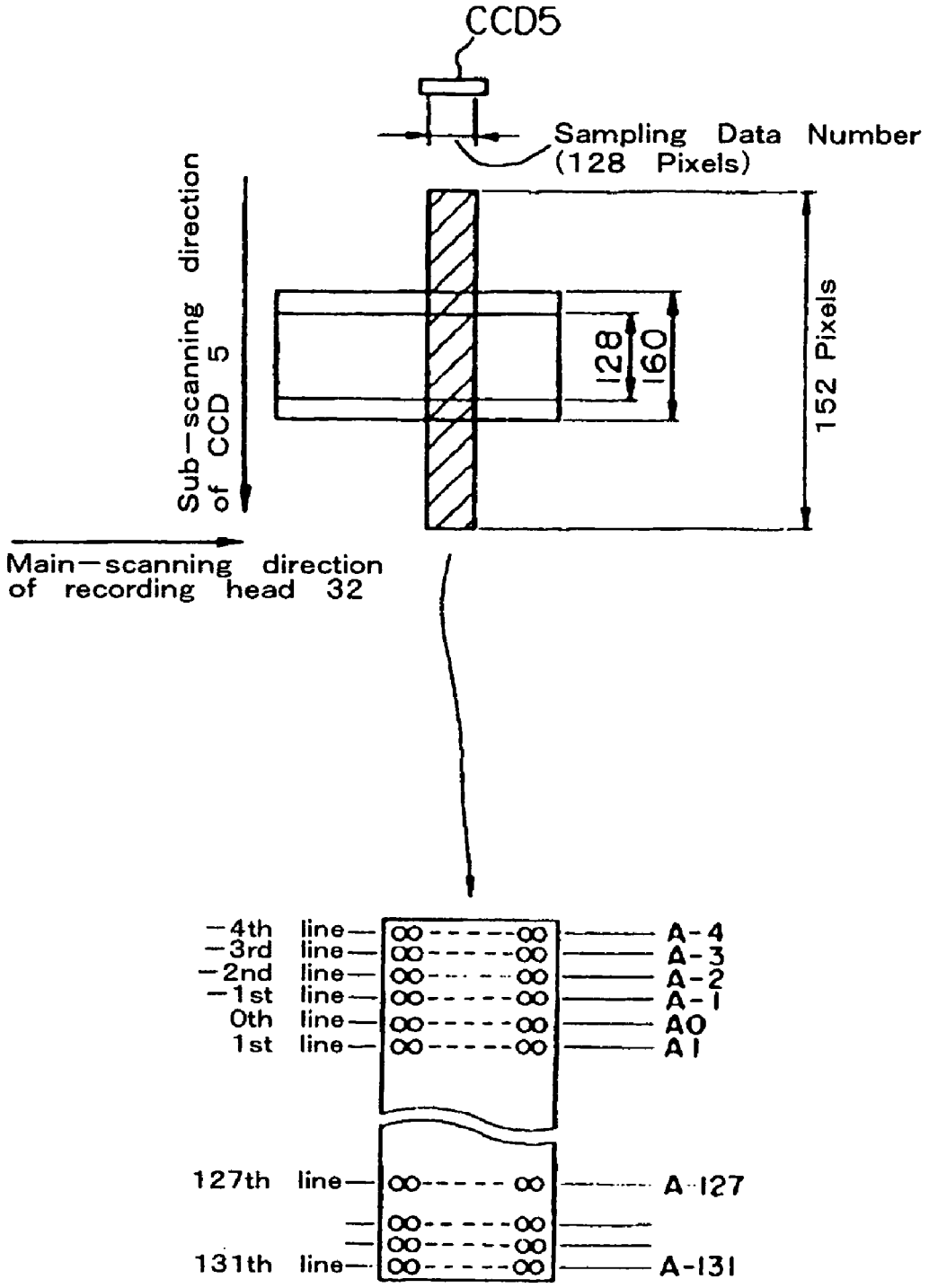
FIG. 28 is an explanatory drawing showing a recorded pattern by the recording head having 128 nozzles.

As shown in FIG. 28, when the pattern recorded by the recording head 32 consisting of, for example, 128 nozzles, is read by the CCD sensor 5 and the like, density data An tend to be blunted by the influence of a background color (for example white) of the recording paper. Consequently, if each block is recorded with only 128 eject ports, there is a possibility of losing reliability in density data of eject ports at both sides of the recording head. In this embodiment, so as to avoid such possibility, the pattern is recorded with 160 eject ports and density data with values more than a predetermined threshold value are treated as effective data. An eject port corresponding to one density data in the center of the effective data is considered as the center eject port. Density data positioned, (the total eject port number)/2(=64 in this case) apart from the center to right/left are considered data corresponding to the first eject port and 128th eject port, respectively.

The nozzle number employed for recording first and third lines of each block is not always limited to 16. In this embodiment, in order to save data storing memory, the nozzle number is decided as 16.

Figure 22:
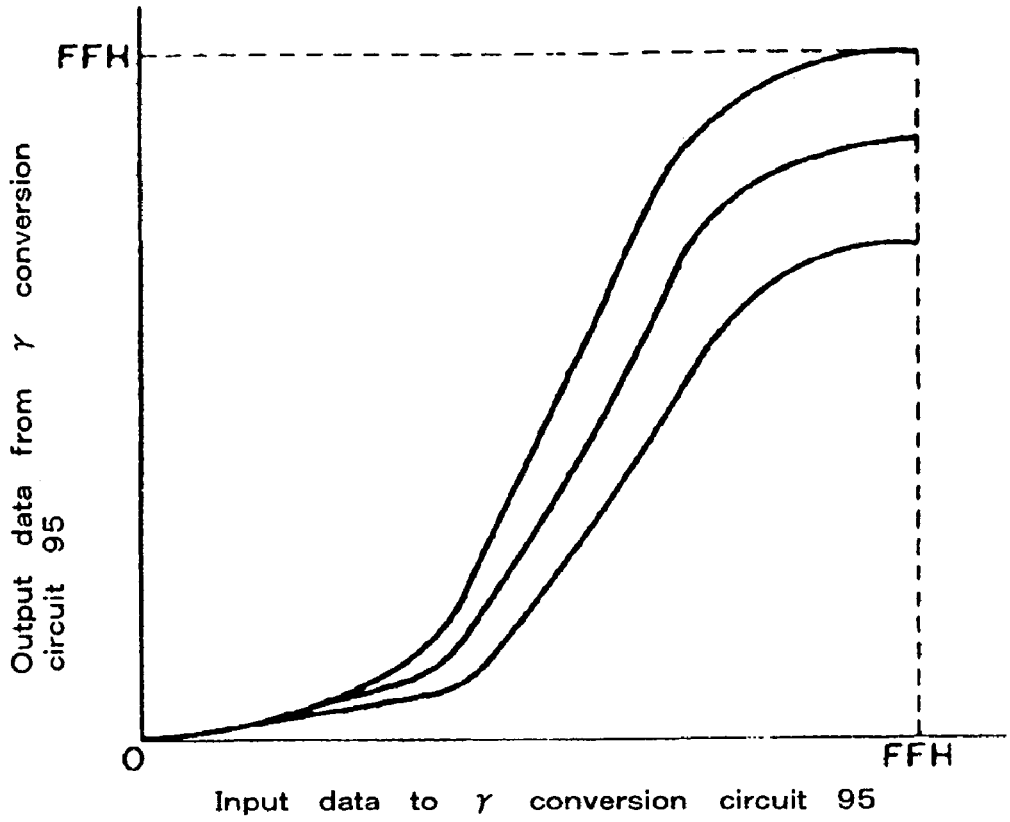
FIG. 22 is a graph showing a relation between input and output data in a γ conversion circuit 95.

After the non-eject/nonuniformity pattern for reading is recorded, an outputted recording paper 2 is placed on the script glass 1 shown in FIG. 22 with the recorded surface facing downward and aligning 4 blocks with the same color in the main scanning direction of the CCD sensor 5, then an operation to read the recorded pattern is started.

Figure 29A:
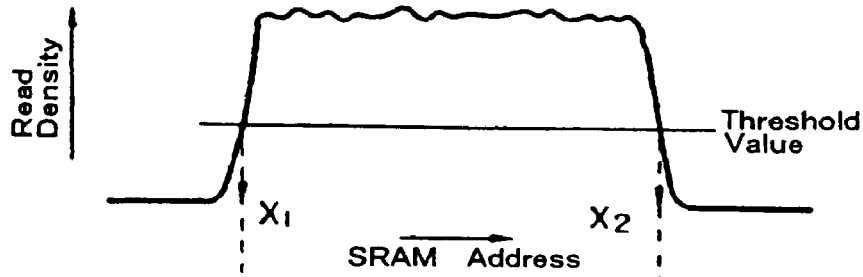
FIGS. 29A, 29B and 29C are explanatory drawings showing read recorded density patterns.
Figure 29B:
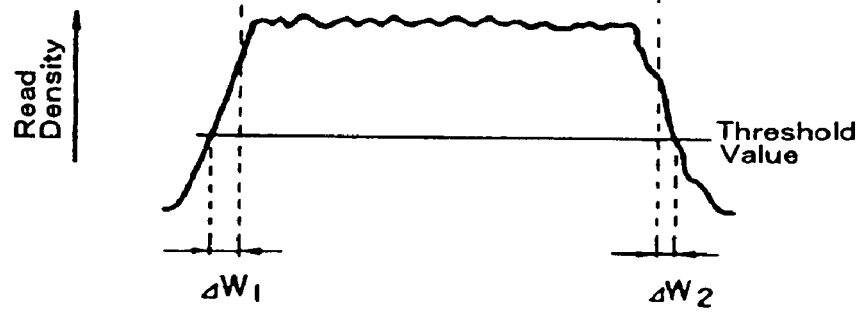

Prior to reading the non-eject/nonuniformity pattern for reading, a shading treatment against the CCD sensor 5 is executed by using a standard white plate 1002 shown in FIG. 22. Here "one line" is defined as one main scanning against 4 blocks with a certain color. When one line is read, read density data corresponding to 4 blocked, for example, black pattern are stored in an SRAM (see FIG. 23). Respective color blocks are recorded at predetermined positions so that read data (density data) on respective 4 blocked colors are stored in a predetermined area of the SRAM. A profile of the read data usually shows a curve shown in FIG. 29A. In the figure, a horizontal direction represents an SRAM address and a vertical direction represents density. As mentioned above, the recorded area is defined as an area with a density more than the determined density level (threshold). Here an address X1, corresponding to a first address where its density exceeds the threshold value, is checked as to whether the address is in an allowable range. In the same way an address corresponding to a last address where its density exceeds the threshold value is defined as "X2". When a starting address of reading is defined as "X", whether X1 is in a range of $X \pm \Delta x$ or not is checked and also whether data corresponding to addresses is in a range of $X1+160 \pm \Delta x$ or not is checked.

When conditions mentioned above are not fulfilled, the reading operation is judged as an error caused possibly by placing the pattern for reading obliquely. The reading operation is executed again or read data are checked again after a rotating calculation is executed on the read data. Thus, respective density data are matched to corresponding nozzles. Density data for each pixel in a range from X1 to X2, which is judged as the recorded area, is checked as to whether the density exceeds a threshold value for judging a non-eject nozzle or not.

Figure 29C:
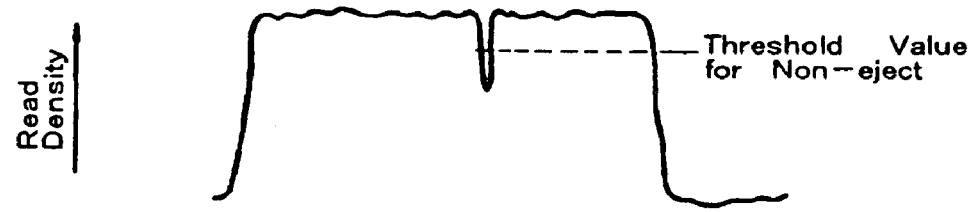

When only one nozzle is judged as a non-eject nozzle as shown in FIG. 29C, usually the density of the judged nozzle is not lowered to the level of the background color of the recording paper. Taking this fact into consideration, the threshold value for judging a non-eject nozzle is set separately and when data in the recording area have lower values than the threshold value, corresponding nozzles are judged as non-eject nozzles.

When the recording head is in unstable statuses, sometimes eject ports are brought to non-eject statuses abruptly.

For example, when non-eject statuses occur in four recording patterns shown in FIG. 27, it is judged as a perfect non-eject status. If there are no non-eject statuses except in one area, the non-eject statuses are judged as unexpected ones, which may be excluded for calculation, or judged as an error and recording operation may start again, instead. The threshold value for judging non-eject statuses is not necessarily set separately, but if the threshold value for judging the recorded area is set at a slightly higher level both non-eject statuses and the recorded area can be checked simultaneously.

Data processed in the above-mentioned way are inputted to a non-eject/nonuniformity calculating circuit 135 (in FIG. 23).

Calculations in the present embodiment are executed for determining non-eject nozzles, and calculations for determining density ratio for correcting nonuniformity will also be explained.

Figure 30:
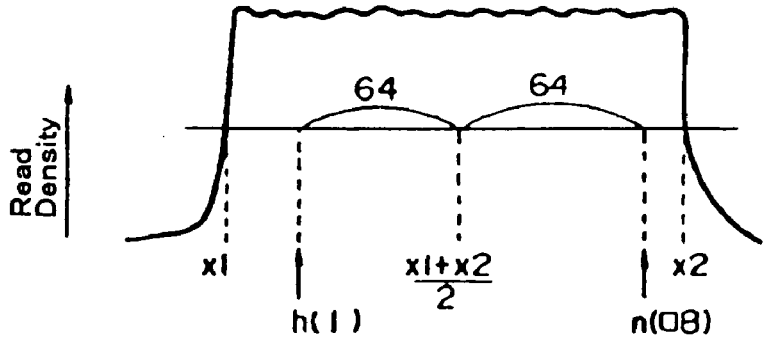
FIG. 30 is an explanatory drawing showing a relation between a recorded density curve pattern and nozzles.

After data in the form a curve shown in FIG. 29C are inputted, succeeding procedures are explained by referring to FIG. 30. An average value of data on both sides, X1 and X2, is calculated and a center value of the recording area is determined. The determined center is judged as a space between 64th and 65th nozzles. Therefore 64th pixels from the center to the right/left correspond, respectively, to the first nozzle and the 128th nozzle. Thus recording densities n(i) for respective nozzles including connecting nozzles to both side nozzles are determined. When recording densities n(i) for respective nozzles are lower than the threshold value for detecting a non-eject nozzle, corresponding nozzles are determined as non-eject nozzles and density ratio information of the determined nozzles is set as d(i)=0. Since calculations on the density ratio are not executed in the present embodiment, density ratio information on remaining nozzles are set as d(i)=1.

The density ratio information can be determined as follows.

An average value AVE of total nozzles except non-eject nozzles is calculated and the density ratio d(i) for respective nozzles is defined as d(i)=n(i)/AVE.

Figure 31:
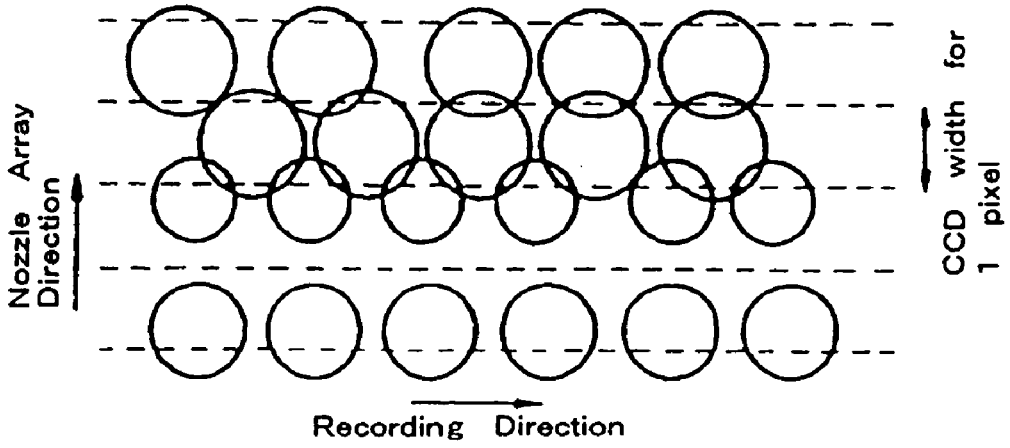
FIG. 31 is a drawing for explaining statuses of pixels in an area to be read.

It is not desirable to use density data corresponding to an area with one pixel width as it is. As shown in FIG. 31, a read area corresponding to one pixel certainly includes densities from dots ejected from nozzles at both sides and it is natural for any nozzle to deviate a little toward a right or left nozzle. In addition when calculations are executed, that density nonuniformity of a pixel observed with human eyes is influenced by surrounding conditions around the pixel should be taken into consideration.

Figure 32:
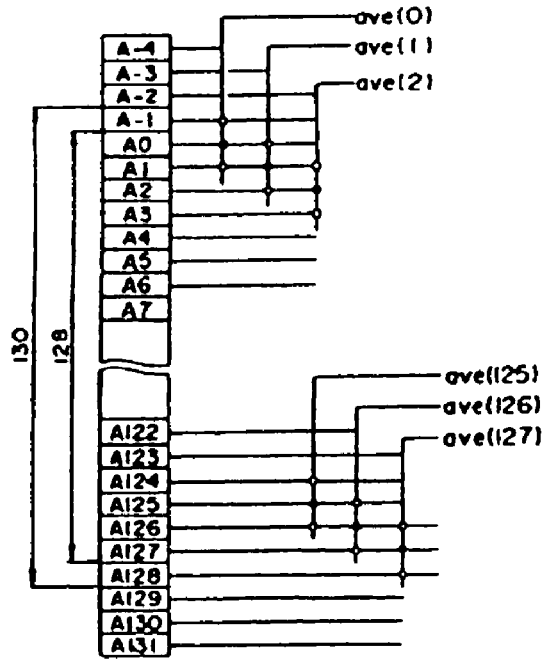
FIG. 32 is a drawing for explaining data of pixel density.

For that purpose, before determining densities of respective nozzles, averaged density data of one pixel and both neighbor pixels ($A_{i-1}$, $A_i$, $A_{i+1}$) as shown in FIG. 32 are successively calculated and the averaged value is defined as a nozzle density ave(i). It is desirable to modify the density ratio information into d(i)=ave(i)/AVE. Correction tables mentioned below are formed by using the modified density ratio information.

The density ratio information is processed by a correction table calculating circuit 136 (see FIG. 23) so that correction tables for respective nozzles are determined.

When a correction table number is defined T(i), the following equations are obtained.

| | |
|---|---|
| T(i) = #63 | 1.31 < d(i) |
| = #(d(i) − 1) × 100 + 32 | 0.69 ≦ d(i) ≦ 1.31 |
| = #1 | 0 < d(i) < 0.69 |
| = #0 | d(i) = 0 |

Figure 24:
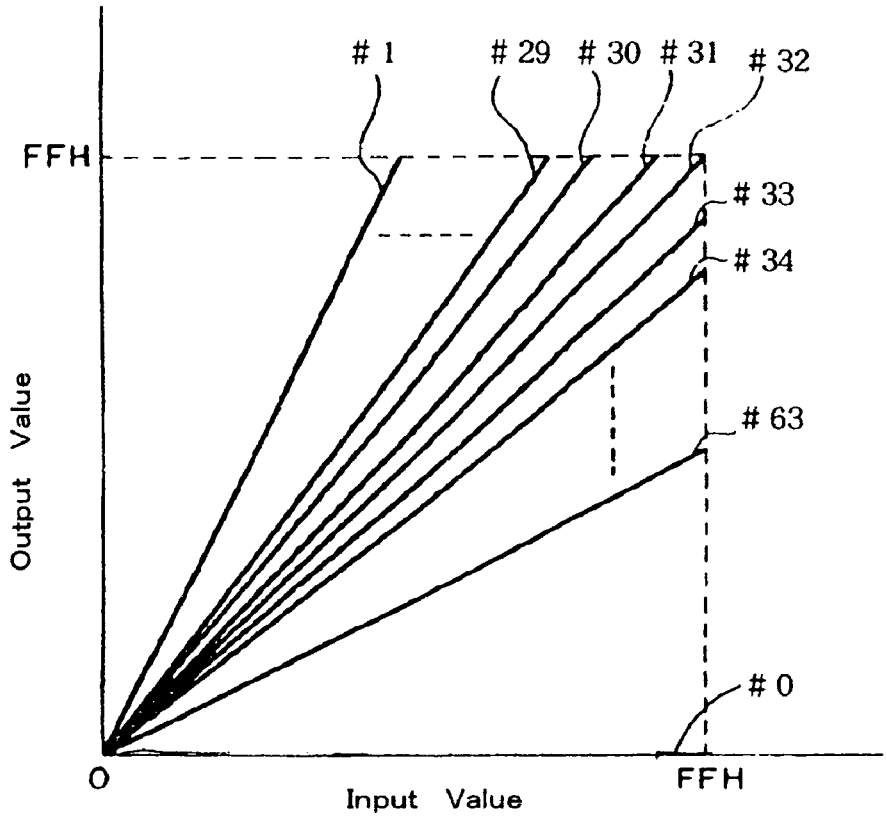
FIG. 24 is a graph showing an example of density compensation tables for nozzles.

Here 64 correction tables #0 to #63 are prepared as shown in FIG. 24, where each table is plotted as its gradient gradually increasing/decreasing from center table #32.

Table #32 has a gradient 1 so that inputted values and outputted values are always equal. FIG. 24 includes tables for determining average densities of 128 eject ports. The density of table #32 is set 50% (80 H) equal to the density of recording sample. Densities of other table numbers are varied 1% by 1% from the center table #32. Accordingly, T(i) obtained by the above-described equations indicate converted signal values corresponding to density ratios when signals are always inputted with 80 H density. #0 corresponds to the non-eject nozzles where all output data are set 0 (zero).

When all 128 T(i) are calculated, calculations of correction table numbers for one line are finished.

However, since calculations for determining density ratios are not executed in the present embodiment, determined density values to all nozzles are #0 or #32.

Operations for reading non-eject nozzles and nonuniformity and based on read data calculations for determining corrected correction table numbers are finished for one line, namely, for one color. The same operations and calculations are repeated for the other remaining three colors. When correction table numbers for 4 colors are completed, data stored in a correction table number storing unit 137 (see FIG. 23) are renewed. Old correction table numbers in this storing unit read from stored information 854 in the recording head functioning as a memory means, and stored information 854 are rewritten.

When detection of non-eject nozzle/nonuniformity is not executed, correction table numbers stored in stored information 854 are utilized in succeeding operations.

Figure 9:
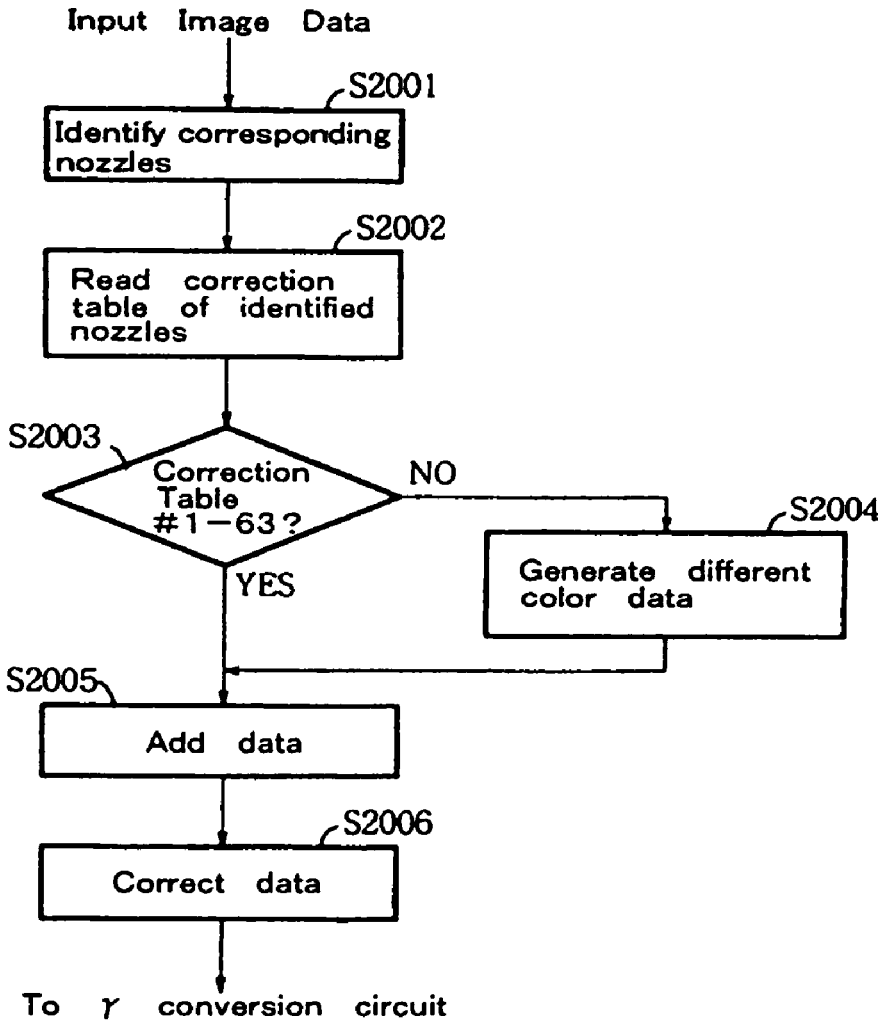
FIG. 9 is a flow chart showing operational procedures by a data conversion circuit.

A data conversion circuit 138 (in FIG. 23) converts outputted image signals by utilizing correction tables for respective nozzles, to signals for respective heads. The flow chart of this conversion is illustrated in FIG. 9.

Image signals on C, M, Y and Bk inputted to the data conversion unit 94, are connected with identified corresponding nozzles (step S2001). If recording operations continue, respective color data constituting the same pixel are selected and processed together.

Here correction tables for respective nozzles are read (step S2002), and converted afterward. The conversion procedure consists of a case where the correction table corresponds to any one from #1 to #63 and a case where the correction table corresponds to #0, namely, a non-eject case, on the whole (step S2003).

When the correction table corresponds to any one from #1 to #63, inputted data are transmitted to a respective color data adding unit (step S2005).

On the other hand when the correction table corresponds to #0, i.e. corresponds to a non-eject nozzle, compensation data for compensating the correction table is generated (step S2004). When inputted signals correspond to C, the correction table #C_Bk is selected, and when inputted signals correspond to M, the correction table #M_Bk is selected so as to generate Bk data. When inputted signals correspond to Y, Bk data is not generated. And when inputted signals correspond to Bk, the correction table #Bk_cmy is selected for generating respective C, M and Y data.

In this embodiment, compensation data are generated such that lightness of the original color and that of the compensating color indicate nearly same values, as mentioned above. FIG. 5 is the graph showing the relation between input data of respective colors and corresponding outputted lightness, and compensation tables are made based on this figure. For example when input data of cyan (C) is 192 (inputted on 8 bit basis), its lightness indicates about 56.

While in black (Bk), when its lightness indicates about 56, inputted data on 8 bit basis is about 56 (Bk=56); consequently, C=192 is converted to Bk=56. A compensation table (#M_Bk) for magenta (M) compensated by black (Bk) obtained in the same way as mentioned above, as well as the compensation table for C (#C_Bk), are plotted in FIG. 6.

Compensations against yellow (C) is not executed particularly, since yellow (C) always shows high lightness. Compensation against black Bk is made by respective colors C, M and Y in the same ratio. The compensation table for Bk (#Bk_cmy) is also plotted in FIG. 6.

Compensation data are formed by utilizing these compensation tables. Actually, however, relations between dot diameters to be recorded and pixel pitches should also be considered. In the present embodiment, for example, a dot diameter to be recorded is about 95 μm and a pixel pitch is 63.5 μm. Which means that an area factor of 100% can be obtained, even when an impacted dot recorded with 100% recording duty is deviated a little bit.

Accordingly, for example, it can be concluded that when only one nozzle is in the non-eject status, influences from dots of neighbor pixels on the non-eject pixel are fairly significant.

In other words, a compensated dot recorded on a non-eject portion influences neighbor pixels more than a little.

The influence is equivalent to lower compensation data obtained from the relation in lightness being applicable, when non-eject nozzles do not occur continuously.

In other words, a defect width caused by the non-eject nozzle virtually makes a pixel area to be compensated narrower; as a result, a compensation data value can be decreased compared with the value determined from a relation between input data and lightness.

A decreased extent of compensation data value can be determined as a non-eject area rate against the number of successive non-eject nozzles, as from a curve in FIG. 43. If compensation data is multiplied by the determined non-eject area rate, corrected compensation data is obtained.

More specifically, when Bk compensation curves against C and M shown in FIG. 6 are defined as f(x) (here x represents input data) and the non-eject area rate against the number of successive non-eject nozzles in FIG. 43 is defined as a, a corrected Bk compensation curve can be expressed as $\alpha*f(x)$.

Figure 7:
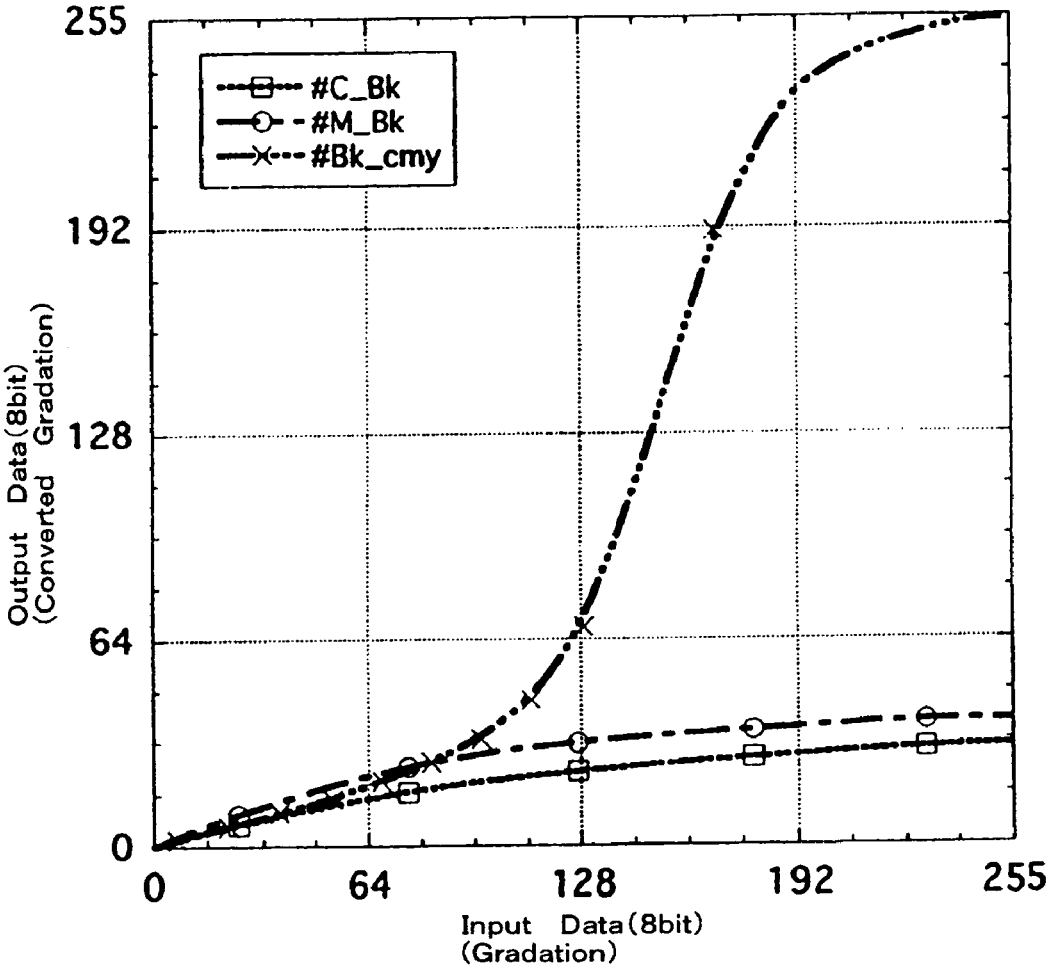
FIG. 7 is a graph showing conversion examples when recording defects are compensated by a different color.

Consequently, compensation tables shown in FIG. 7 are employed in the present embodiment.

In the same way, it is preferable to determine different compensation tables for respective cases of one non-eject nozzle, two successive non-eject nozzles, three successive non-eject nozzles and so on. In these cases, new corrected compensation data can be obtained by multiplying the non-eject area rate against the number of successive non-eject nozzles by original compensation data, thus more accurate compensation is attained by adding corrected lightness to the lightness of the compensation color.

Generated compensation data of respective colors in the above-mentioned ways are transmitted to a data adding unit (step S2005, in FIG. 9).

The data adding unit has a function for holding respective color data and a calculating function. When compensation data is inputted to this unit in the first place, data is kept as it is. When other data are already kept, inputted data is added. When added results exceed 255 (FFH), they are kept as 255. In the present embodiment, simple adding procedures are employed, but other calculating methods and tables may be utilized, if necessary.

After adding procedures to all colors, C, M, Y and Bk, are finished, added results are transmitted to a data correction unit and data kept in the data adding unit is reset so as to wait for processing the next pixel. Data transmitted to the data correction unit are converted according to correction tables (#0 to #63) (step S2006). Thus, a series of data conversion procedures is finished.

Data converted in the above-mentioned way are transmitted via a y conversion circuit 95, a conversion circuit to binary data 96 (see FIG. 21) and so forth and outputted as images.

When outputted images in this way are observed intently by closing eyes, non-eject portions can be recognized, but image quality is excellent on the whole.

<Processing Examples by Head Shading>

Among a series of operations of the head shading, i.e., nonuniformity compensations, compensations against non-eject nozzles are executed. Hereinafter compensation procedures are explained more specifically.

The present embodiment is executed in the same system as mentioned above. Different features from the previous embodiments are: (1) corrections to nonuniformity are executed and (2) correction data by other colors are not generated in the present embodiment.

Hereinafter data conversions, namely, processing operations by the non-eject nozzle/density nonuniformity measuring unit 93 and the data conversion unit 94 (in FIG. 21), mainly on the two features (1) and (2), are explained.

Processing operations by the non-eject nozzle/density nonuniformity measuring unit 93 are basically the same as the previous embodiment. As shown in the block diagram in FIG. 23, at first the non-eject/nonuniformity pattern for reading is recorded. The recorded pattern is read by employing the CCD sensor. The read data are processed such as adding calculations, averaging calculations and the like so that density n(i) to be recorded corresponding to respective nozzles as shown in FIG. 30 is obtained.

Fundamental factors to generate nonuniformity are explained for understanding the present embodiment more easily.

Figure 19A:
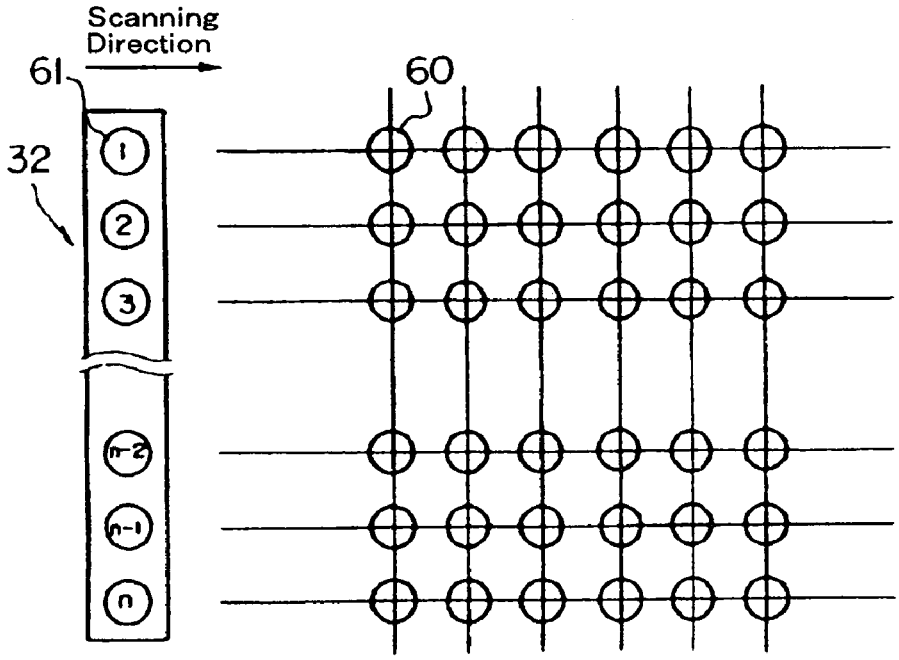
FIG. 19A is a schematic drawing showing a recorded status by an ideal recording head and FIG. 19B is a schematic drawing showing a recorded status with drop diameter dispersions and twisted portions.

FIG. 19A is the schematic view showing the enlarged recording status recorded by an ideal recording head 32. In the figure, a reference numeral "61" represents ink eject ports arranged in the recording head 32. When recorded by the recording head 32, ink spots 60 with uniform drop diameter (liquid droplet diameter) are recorded in an arrayed state on the recording paper.

The schematic drawing in the figure is an example recorded with so called full ejection (all eject ports are activated). However when recorded with a half tone of 50% ejection, nonuniformity is not generated in this case.

Figure 19B:
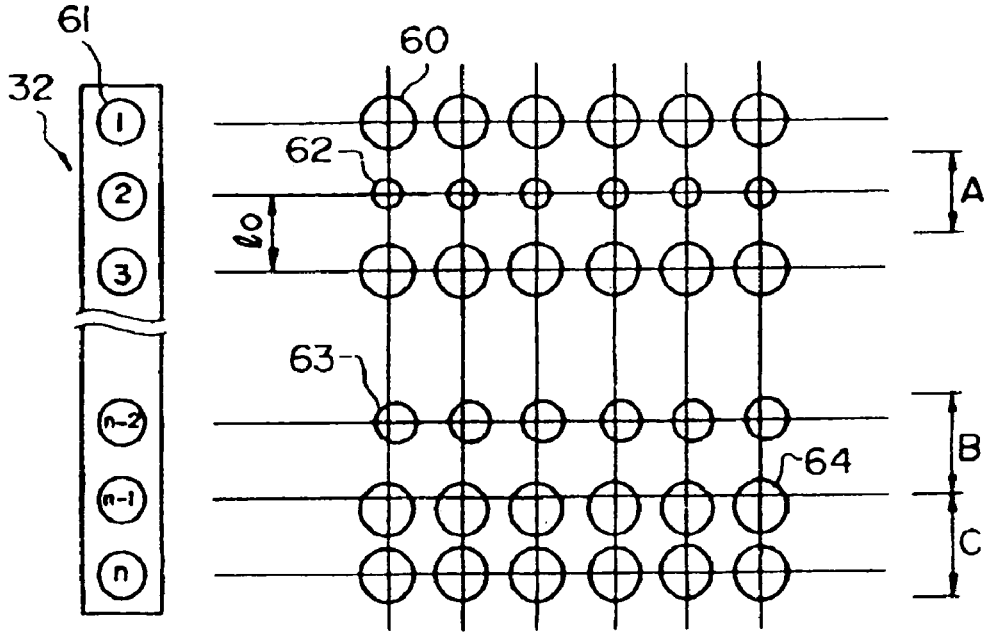

On the other hand, in a case shown in FIG. 19B, diameters of drops 62 and 63 ejected from second and (n−2)th eject ports are smaller than the other, and drops from (n−2)th and (n−1)th eject ports are recorded on positions deviated from ideal positions. More specifically, drops from the (n−2)th eject port are recorded at right-upward positions from ideal centers and drops from the (n−1)th eject port are recorded at left-downward positions from ideal centers.

Area A shown in FIG. 19B appears as a thin streak as a recorded result. Area B also results in a thin streak, because a distance between centers of drops from (n−1)th and (n−2)th eject ports is larger than an average distance $l_0$ between two neighbor drops. On the other hand, area C appears as a thicker streak than other areas because a distance between centers of drops from (n−1)th and nth eject ports is smaller than the average distance $l_0$ between two neighbor drops.

As mentioned above, density nonuniformity appears to be caused mainly by dispersed drop diameters and deviated drops from centers (usually called as the twisted state).

As a means to cope with the density nonuniformity, it is effective to employ the following method such that image density of a certain area is detected and quantity of ink to be ejected to that area is controlled based on the detected image density.

Figure 20A:
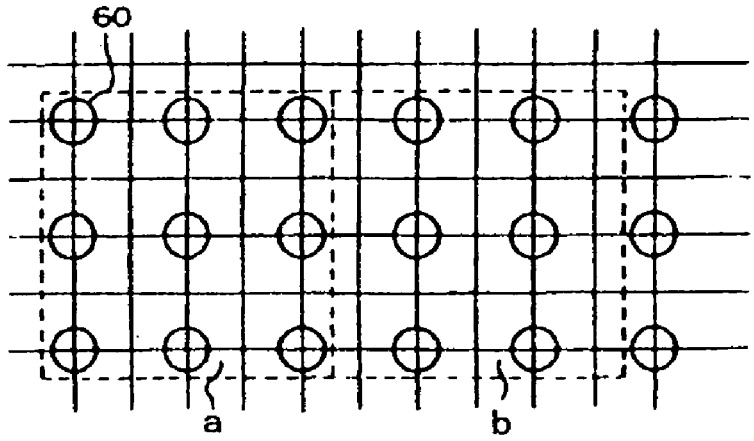
FIG. 20A is a schematic drawing showing a 50% half toned status by an ideal recording head and FIG. 20B is a schematic drawing showing a 50% half toned status with dispersed drop diameters and twists.
Figure 20B:
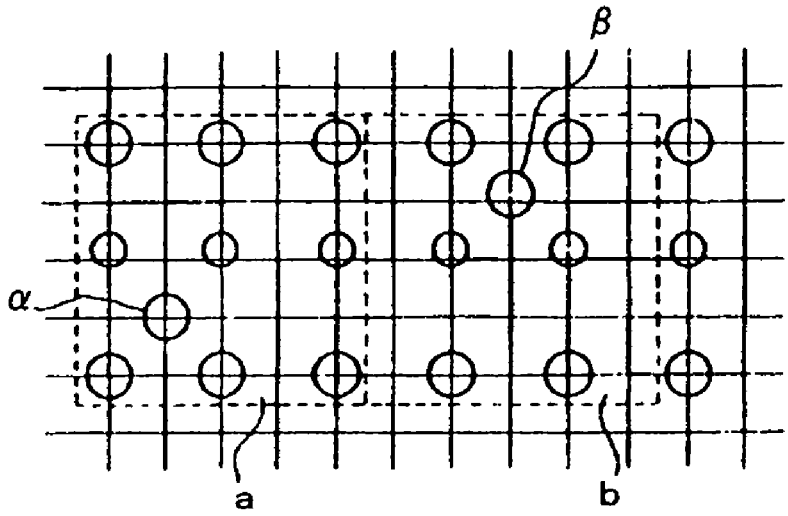

The density nonuniformity, caused by dispersed drop diameters or twisted states as shown in FIG. 20B compared with a recorded image by the ideal recording head recorded with a 50% half tone as shown in FIG. 20A, can be made inconspicuous, in the following way. For example, when summed dot areas existing in area a surrounded by a broken square in FIG. 20B is adjusted so as to be near to summed dot areas existing in area a surrounded by a broken square in FIG. 20A, even an image by recorded by a recording head having characteristics as shown in FIG. 20B is judged by human eyes that the recorded image has the same density as that of the image in FIG. 20A.

In the same way an area b shown in FIG. 20B can be adjusted so as to remove the density nonuniformity.

FIG. 20B illustrates adjusted density compensation results in a model form for explaining simply. Reference characters "α" and "β" represent dots for compensation.

This system can be applied to non-eject nozzles, when drop diameters from non-eject nozzles are considered nearly zero.

In this respect, modified density ratio data D(i) for respective nozzles in the previous embodiment defined as follows are important.

$$D(i)=ave(i)/AVE$$

Here ave(i) is an average density of densities of three successive nozzles (n(i−1), n(i), n(i+1)), namely.

$$ave(i)=(n(i-1)+n(i)+n(i+1))/3$$

And AVE is defined as follows.

$$AVE=\Sigma(n(i)/128),\ \text{here } i=1 \text{ to } 128$$

When a $i_0$th nozzle is a non-eject nozzle, it is set that $n(i_0)=d(i_0)=0$. Consequently, the effective density of both neighbor $(i_0+1)$th, $(i_0-1)$th nozzles, $ave(i_0+1)$ and $ave(i_0-1)$, respectively, indicate much smaller values than $n(i_0-1)$ and $n(i_0+1)$. As a result, since density ratio information $d(i_0+1)$ and $d(i_0-1)$ become virtually smaller, higher density output values are set by a compensation table being mentioned below so as to compensate non-eject nozzles. Therefore, effective density ave(i) for respective nozzles are not limited to simply averaged values, but properly weighted averaged values. For example, ave(i)=(2n(i−1)+n(i)+2n(i+1))/5 and the like can be employed.

The density ratio information d(i) obtained in the above mentioned way is processed by a correction table calculating circuit 136 (see FIG. 23) of the data conversion unit 94 so that correction tables for respective nozzles are determined. Since this processing procedure is the same as the previous embodiment, further explanations are omitted.

Figure 25:
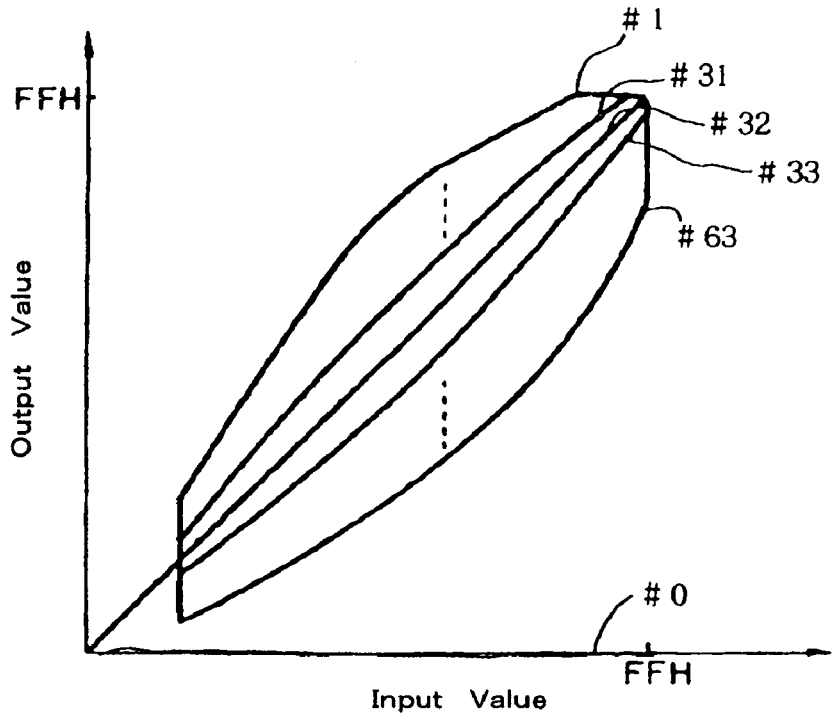
FIG. 25 is a graph showing an example of non-linear density compensation table for nozzles.

64 density correction tables are depicted in FIG. 24, but correction tables are increased or decreased in accordance with required conditions. Non-linear correction tables as shown in FIG. 25, for example, can be also employed in accordance with properties of media to be recorded and inks.

After correction tables for all nozzles are determined, contents in a correction table number storing unit 137 and stored information on recording head 854 are renewed (see FIG. 23). Data conversion on an image to be outputted is executed in a data conversion circuit 138 by utilizing the determined correction tables. In this case, data are converted in the same way as the previous embodiment, but more simply since compensations by other colors are not executed.

A flow chart for the present case is similar to the flow chart shown FIG. 9, but the following steps are omitted: correction table identifying step (S2003), generating different color data step (S2004) and data adding step (S2005). Compensated data are transmitted to a γ conversion circuit 95, if required, then converted to binary data by a conversion circuit 96 to binary data and outputted as images.

Images obtained in the above mentioned way are excellent in such a manner that effects by non-eject statuses are hardly observed particularly in highlighted portions.

However, white streaks caused by non-eject statuses are not always compensated in portions recorded with high duty.

Second Embodiment

<Head Shading and Compensation with Different Colors>

Since the present embodiment is an embodiment where compensations of non-eject statuses by different colors and by the head shading are combined, the compensation can be executed by the same system employed in the head shading of the first embodiment.

Hereinafter data conversion processes by the present embodiment are explained.

The non-eject nozzle/density nonuniformity measuring unit 83 shown in FIGS. 21 and 23 executes the same operations as the first embodiment; more specifically, the operation to record non-eject/nonuniformity pattern for reading, the operation to detect non-eject nozzles, the operation to calculate recording densities for respective nozzles and the operation to calculate the density ratio information of respective nozzles are executed.

The calculated density ratio information is processed by the correction table calculating circuit 136 in the data conversion unit 95 similarly to the first embodiment and correction tables for respective nozzles are determined. The determined correction tables renew contents in the correction table number storing unit 137 and stored information on recording head 854, and the renewed contents are utilized by the data conversion circuit 138. Processing operations in the data conversion circuit 138 are basically the same as operations in the above-mentioned embodiment (see FIG. 9)

A different point from the previous embodiment is that when a nozzle indicates the non-eject status, namely the correction table number is #0, contents of the compensation table by different colors for generating compensation data by different colors are different. In the present embodiment, it is desirable not to compensate highlighted portions recorded with relatively low recording duty by different colors, since density corrections for respective nozzles are executed by the shading and densities of neighbor nozzles to the non-eject nozzle are corrected so as to compensate the non-eject nozzle. Even when portions recorded with high recording duty are compensated, extents of compensations by different colors can be reduced compared with the above-mentioned embodiment due to above-mentioned effects by density corrections in neighbor nozzles.

More specifically, when correction curves for C and M in FIG. 6 are expressed as f(x), new correction curves by Bk are expressed as $\beta*f(x-\delta)$. An example of the new correction curve is plotted in FIG. 8. The factor "β" in the new correction curves has a range of $0<\beta<1$ and the factor "δ" has a range of $0\leqq\delta\leqq255$. In the correction curve plotted in FIG. 7, β is about 0.3 and δ is about 128.

Figure 8:
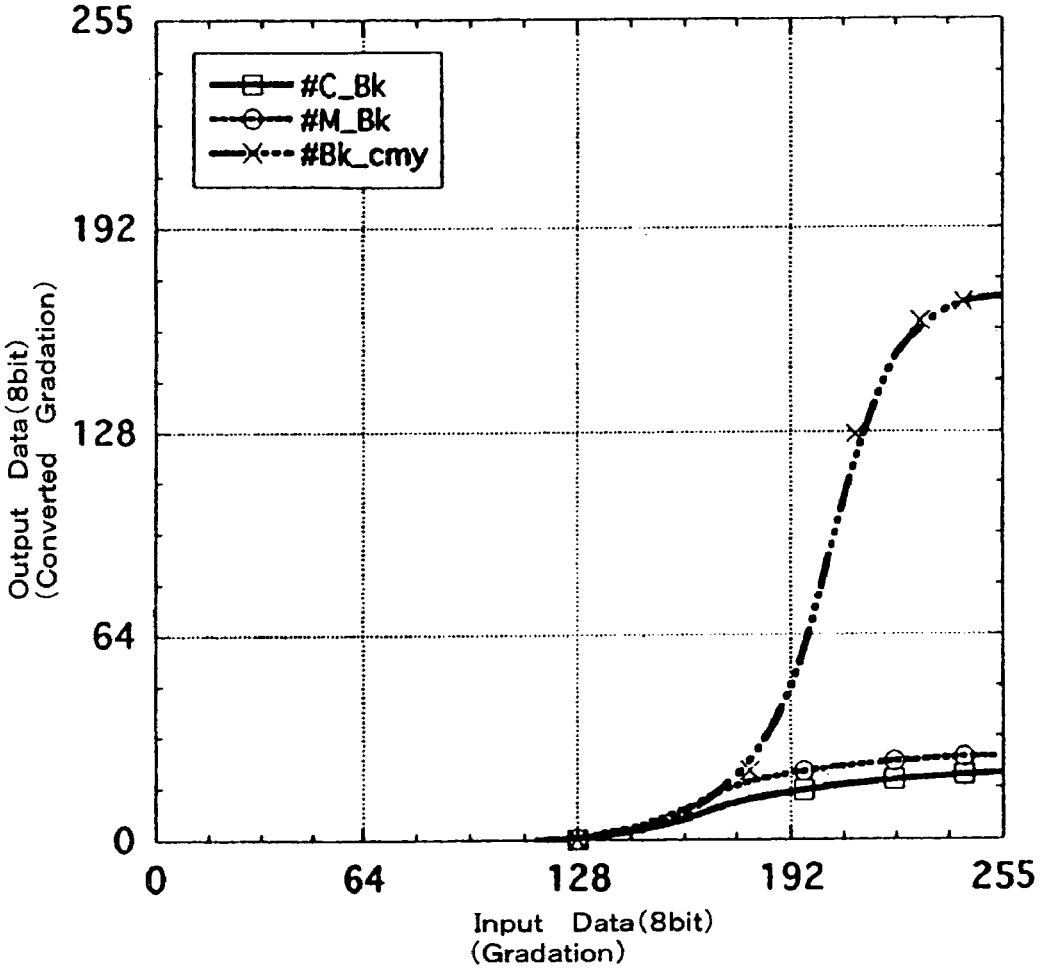
FIG. 8 is a graph showing conversion examples when recording defects are compensated by a different color.

Consequently, data conversions are executed by employing correction tables by different colors shown in FIG. 8 in the present embodiment.

Dot numbers for compensations by different colors can be reduced, since dots ejected from neighbor nozzles to the non-eject nozzle are recorded more by the above-mentioned head shading operations. For example, FIG. 4F is the conceptual diagram showing the compensation table so as to correct densities of neighbor nozzles to the non-eject nozzle to raise 1.5 times (corresponds to a correction curve 4*b*) of the inputted values as shown in FIG. 24 compared with the case without compensations (corresponds to a correction curve 4*a*). These compensations recorded with 1.5 times density correspond to FIGS. 4A, 4B and 4D. Dots up to 4 can be recorded in respective grids shown in FIGS. 4A, 4B, 4C and 4D. Therefore, FIG. 4A illustrate a uniform pattern to be recorded with low duty, i.e. one dot/grid.

Nozzles in a recording head to be used for recording dots in FIG. 4C, are arrayed in a vertical direction of this figure, where a non-eject nozzle corresponds to a third row from the top. In these figures, circles in solid line indicate dot positions recorded by normal nozzles, circles in fine dotted line indicate dot positions to be recorded by non-eject nozzles and circles in coarse dotted line indicate dot positions to be compensated. As can be understood from these figures, it is desirable that compensations by neighbor nozzles to the non-eject nozzle should be recorded with densities of 1.5 times.

However, in images recorded with high recording duty, white streaks tend to be seen conspicuously. Since sometimes dots are recorded in small sizes depending on recording media, white streaks are seen conspicuously in images recorded with more than ½ recording duty. In images to be recorded with high recording duty, defect portions can be made inconspicuous, when positions corresponding to non-eject nozzles are compensated by dots from other colors. Therefore, in images to be recorded with more than ⅔ (67%) recording duty, dots from neighbor nozzles to non-eject nozzles are recorded with 100% recording duty and at the same time positions corresponding to the non-eject nozzles are compensated by other colors. When defects are made inconspicuous only by neighbor nozzles to the non-eject nozzles, theoretically it is necessary to record with more than 100% recording duty. However, since positions corresponding to non-eject nozzles are compensated by other colors, recording duty to record dot numbers from the neighbor nozzles can be reduced to 100%.

When images are recorded by converting data in the way mentioned above, images with high quality in almost all portions, including highlighted portions and shadow portions, are obtained.

Third Embodiment

The present embodiment is different from the second embodiment in the following two features. One feature is that twisted nozzles as well as non-eject nozzles are detected and treated as non-eject nozzles altogether. Another feature is that density correction tables of next neighbor nozzles are revised. Hereinafter the present embodiment, particularly regarding the two features, is explained.

The present embodiment is executed using the same system as the second system

In the non-eject nozzle/density nonuniformity measuring unit 93 in the present embodiment, a series of the following operations are executed. (1) Operation to output a non-eject/twisted status detecting pattern. (2) Operation to detect non-eject/twisted statuses. (3) Operation to output a density nonuniformity pattern. (4) Operation to read the outputted density nonuniformity pattern. (5) Operation to calculate recording density for respective nozzles. (6) Operation to calculate density ratio information for respective nozzles.

Figure 10:
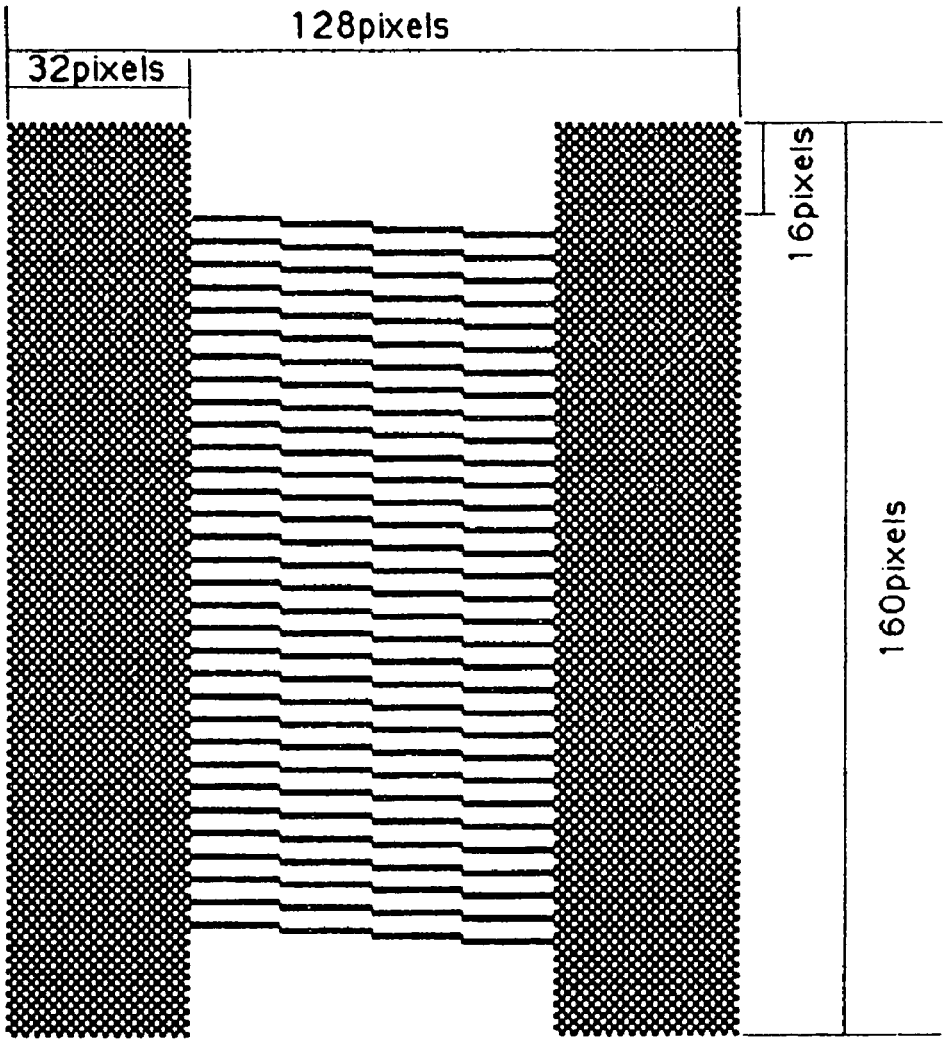
FIG. 10 is an example of a stage shaped pattern for detecting non-eject/twisted states

The non-eject/twisted status detecting pattern in operation (1) mentioned above is not specially limited so long as non-eject nozzles and twisted nozzles can be detected. In the present embodiment, the stage shaped pattern as shown in FIG. 10 is outputted for detecting eject statuses. Nozzle positions are determined by utilizing right/left portions recorded with 50% recording duty in the outputted pattern in the same way as the first embodiment. Nozzle positions and ejected positions are compared by utilizing the stage shaped chart recorded at the center portion of the outputted pattern. Positions indicated by the maximum value in read data of the stage shaped pattern are compared with nozzle positions.

In the present embodiment, a sampling procedure to read the stage shaped chart is executed in the same way as record density reading. When a corresponding nozzle does not indicate a maximum value, it is judged as a non-eject nozzle or a largely twisted nozzle and correction table #0 is determined for this nozzle. Table #32 is determined for other remaining nozzles and the operation goes to the next step.

Without using non-eject nozzles and twisted nozzles, namely, by using correction tables determined in the previous step, the density nonuniformity pattern for reading as shown in the present embodiment 3 is outputted, and then density nonuniformity is read, recording densities for respective nozzles are calculated and density ratio information for respective nozzles are calculated.

Thus, though it takes time more or less, more precise compensations can be attained by detecting and processing twisted nozzles as well as non-eject nozzles.

Hereinafter procedures in the data conversion unit 94 are explained.

In the correction table calculating circuit 136 shown in FIG. 23, density ratio information for respective nozzles is read and density correction tables are determined. Tables are determined in the same way as the previous embodiment 2. However, in the present embodiment, tables are revised as follows.

When a non-eject nozzle, namely, #0 table, is determined, density tables of the next neighbor to the non-eject nozzles are changed. Corresponding density tables are changed by multiplying a function expressed as a curve "a" in FIG. 11 so that density tables are changed and re-determined as revised density tables for the next neighbor nozzles to the non-eject nozzle.

Figure 11:
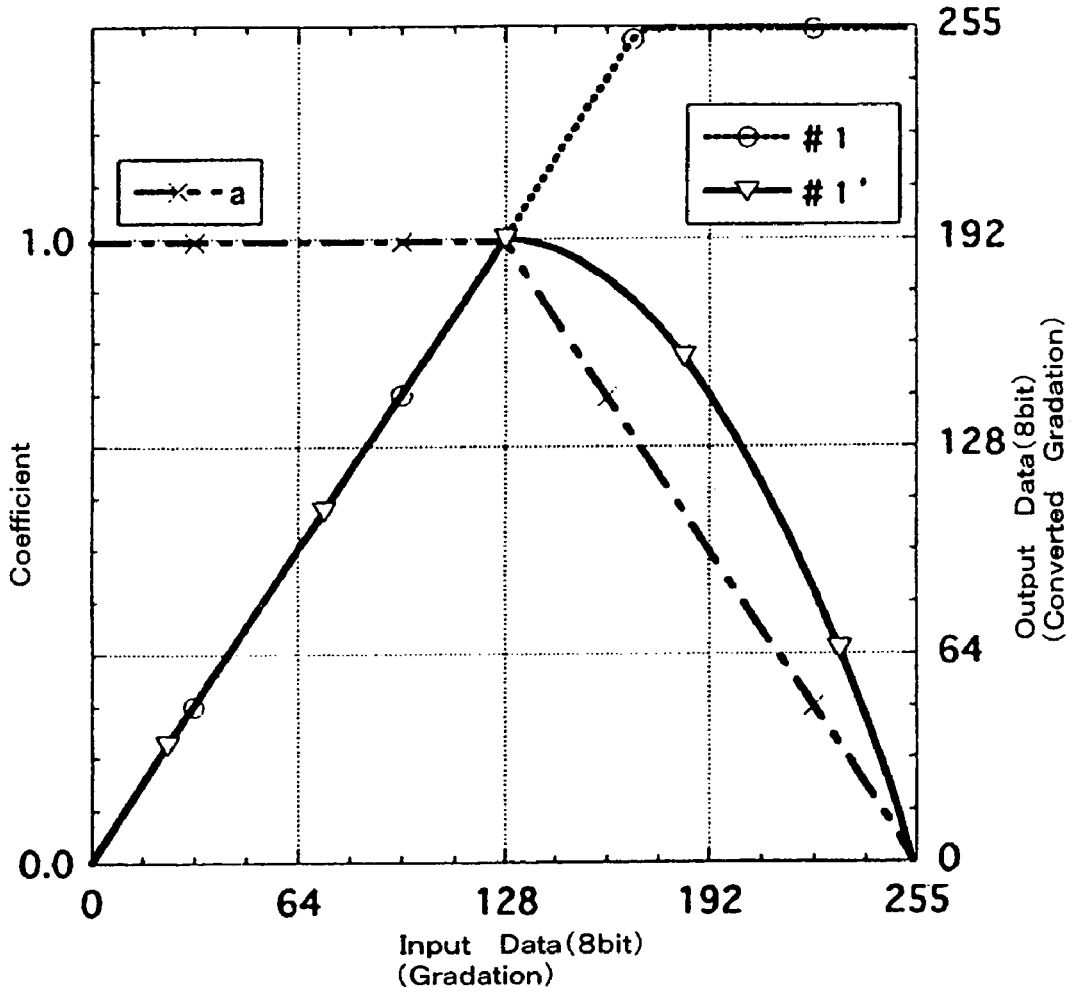
FIG. 11 is a graph showing density correction tables multiplied by function "a".

For example, a nozzle having #1 correction table in FIG. 11 is changed to #1' correction table, if the nozzle is the next neighbor to the non-eject nozzle.

Figure 12:
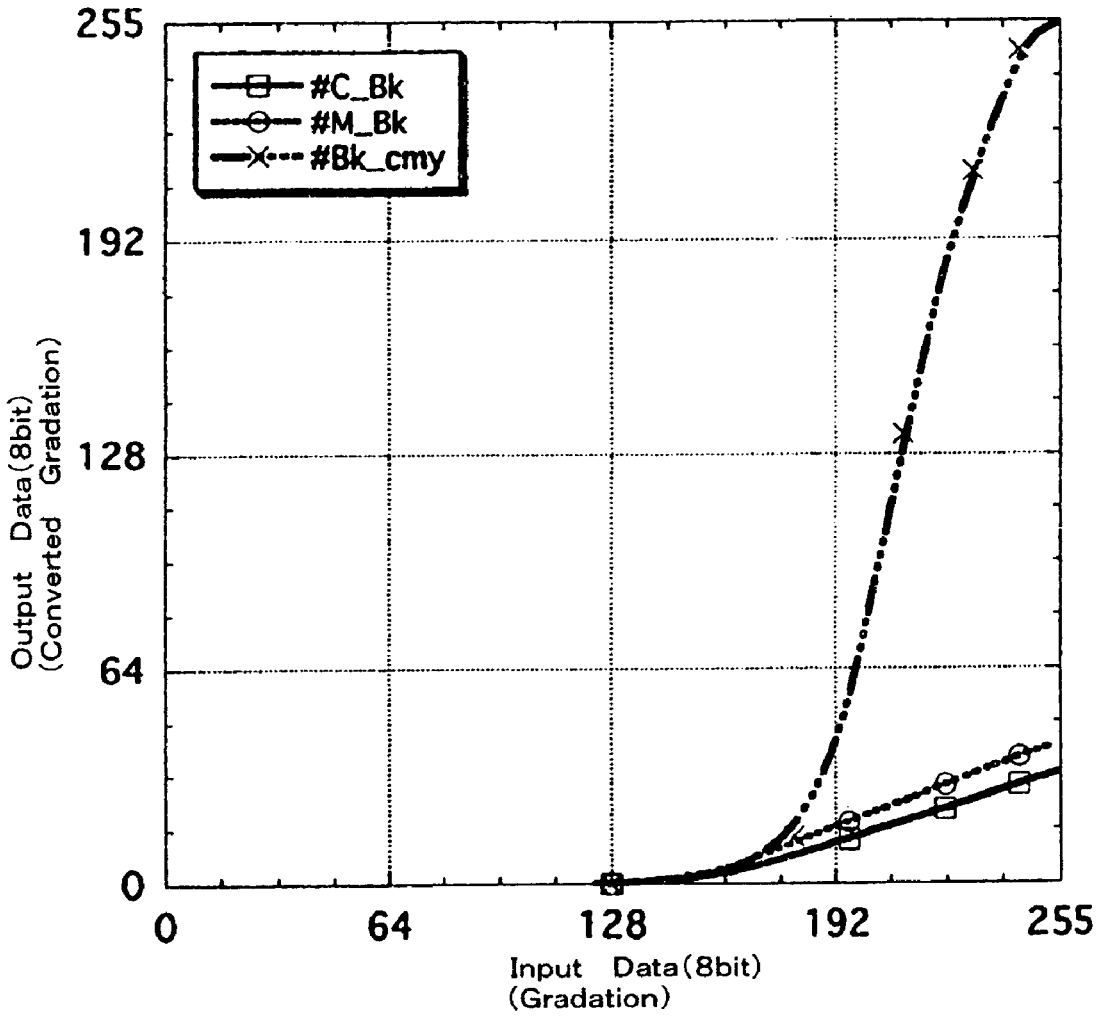
FIG. 12 is a graph showing conversion examples when recording defects are compensated by different colors.

After density correction tables are revised in the above-mentioned way, data conversion processes are executed by utilizing compensation tables by other colors as shown in FIG. 12 in the same way as the embodiment 2.

Characteristic features of the compensation on non-eject nozzles by the present embodiment are as follows. Highlight portions are compensated mainly by the head shading and shadow portions are compensated mainly by compensation of non-eject nozzles by other colors.

When an image is recorded after converting data in the way mentioned above, images with high quality in almost all portions are obtained The present invention exhibits its features more effectively when applied to recording heads or recording apparatuses that employ ink-jet recording methods, particularly, methods utilizing thermal energy generating means (electro-thermal energy conversion body, laser light source and the like) for utilizing the generated energy so that phase change is caused in ink.

It is preferable to employ such typical methods, constitutions or principles of recording apparatuses disclosed in, for example, U.S. Pat. Nos. 4,723,129 and 4,740,796. The disclosed methods can be applied either to a so-called on-demand type recording apparatus or to a continuous type recording apparatus. However, the on-demand type recording apparatus is effective in that at least one driving signal corresponding to information to be recorded is applied to an electro-thermal energy conversion body arranged on a sheet or a liquid path where ink is kept so as to raise temperature above nucleate boiling in a short period by generating energy in the electro-thermal energy conversion body; consequently, bubbles can be formed in accordance with the applied driving signal. Ink is ejected via an opening for ejecting by growing/shrinking generated bubbles so that at least one droplet is formed. It is more preferable to adjust the applied signal into in a pulse form, since bubbles are instantly and properly grown/shrunk in accordance with the applied signal; namely, liquid (ink) ejection with excellent response in particular is attained. Driving signal forms disclosed in U.S. Pat. Nos. 4,463,359 and 4,345,262 are suitable as the driving signals with pulse forms. In addition, when conditions described in U.S. Pat. No. 4,313,124, an invention relating to temperature raising rate on the above-mentioned thermal active surface, are employed, more excellent recording results can be attained.

Arrangements of recording heads described in U.S. Pat. Nos. 4,558,33 and 4,459,600 disclosing eject ports arranged on bent areas to which thermal energy is applied as well as combinations of eject ports, liquid paths and electro-thermal conversion bodies are included in the present invention. In addition, features adoptable by the present invention are also exhibited in an invention described in Japanese Laid-open Patent Application No. 59-123670 relating to common slits as eject ports corresponding to a plurality of electro-thermal energy conversion bodies, and in an invention described in Japanese Laid-open Patent Application No. 59-138461 disclosing an arrangement where openings to absorb pressure waves from thermal energy are arranged opposed to eject ports. In other words, recording operations are effectively executed without fail by the present invention, no matter what types of recording head are employed.

The present invention also can be applied to a full line type recording head capable of recording on a recording medium with a maximum width. The full line type recording head can be constituted either by combining a plurality of recording heads or by a monolithically formed recording head.

Further, the present invention can be applicable to any type of recording head such as the above-mentioned serial type, an exchangeable chip type recording head capable of being supplied with ink from a recording apparatus, onto which the recording head is mounted or electrically connected and a cartridge type recording head where an ink tank is monolithically formed with the recording head.

Since the present invention can exhibit its features more effectively, it is preferable to add a recording head recovery means and auxiliary supporting means as components to the recording apparatus of the present invention. More specifically, these include a capping means against the recording head, a cleaning means, a pressurizing or suction means, a spare heating means comprising an electro-thermal conversion body, another heating element, or a combination of these heating bodies or pre-ejecting means for ejecting ink before recording.

Either one recording head for mono color ink or a plurality of recording heads for mono color inks with different densities or a plurality of inks are applicable to the present invention. Namely, the present invention is applicable not only to a recording apparatus employing a recording mode with a main color such as black, but to a recording apparatus employing a monolithically arranged recording head or a combination of a plurality of recording heads. In addition the present invention is quite effective with a recording apparatus employing at least one of the following recording modes: a mode of printing with a plurality of different colors and a full color mode attained by mixing primary colors.

The present invention minimizes nonuniformity in a recorded image such as white streaks generated by non-eject dots or the present invention makes the nonuniformity caused by non-eject statuses to be not recognizable by human eyes, which suppresses operating costs of the ink-jet recording apparatus and further attains effects enabling much faster recording rates.

What is claimed is:

1. A recording apparatus for recording a color image on a recording medium by utilizing a recording head having a plurality of recording elements for recording a plurality of colors, comprising:

recording head driving means for driving said plurality of recording elements of said recording head in accordance with image data; and compensation means for compensating a position to be recorded by a recording element, among said plurality of recording elements, which does not execute a recording operation with dots of a color different from that of said recording element which does not execute the recording operation, wherein a number of compensation dots recorded by said compensation means is less than a number of dots intended to be recorded by said recording element which does not execute the recording operation, and the lightness per a predetermined area of an image obtained by the compensation dots is within a range of ±20% of the lightness per the predetermined area of the image obtained by dots intended to be recorded by said recording element which does not execute the recording operation.

2. The recording apparatus according to claim 1, wherein the lightness per the predetermined area of the image obtained by the compensation dots is within a range of ±10% of the lightness per predetermined area of the image obtained by dots intended to be recorded by said recording element which does not execute the recording operation.

3. The recording apparatus according to claim 1, wherein said compensation means comprises correction means to correct image data corresponding to the recording element which does not execute the recording operation, in accordance with a recording color for the compensation and executes a compensation recording operation based on the corrected image data by said correction means.

4. The recording apparatus according to claim 1, wherein said recording element which does not execute the recording operation includes a recording element incapable of executing the recording operation.

5. The recording apparatus according to claim 1, wherein said recording head is an ink-jet head having a plurality of nozzles for ejecting ink.

6. The recording apparatus according to claim 1, wherein the lightness of the compensation dots is lower than the lightness of dots intended to be recorded by said recording element which does not execute the recording operation.

7. A recording apparatus for recording a color image on a recording medium by utilizing a recording head having a plurality of recording elements for recording a plurality of colors, comprising:

recording head driving means for driving said plurality of recording elements in accordance with image data; and compensation means for compensating a position to be recorded by a recording element, among said plurality of recording elements, which does not execute a recording operation with dots of a color different from that of said recording element which does not execute the recording operation, wherein the lightness of compensation dots is lower than the lightness of dots intended to be recorded by said recording element which does not execute the recording operation, and a number of the compensation dots recorded by said compensation means is less than a number of dots intended to be recorded by said recording element which does not execute the recording operation.

8. A recording method for recording a color image on a recording medium by utilizing a recording head having a plurality of recording elements for recording a plurality of colors, comprising the steps of:

identifying a recording element, among said plurality of recording elements, which does not execute a recording operation;

recording an image based on image data; and compensation recording to compensate a corresponding position, intended to be recorded by said identified recording element during said image recording step, with different color dots, wherein a number of compensation dots recorded in said compensation recording step is less than a number of dots intended to be recorded by said identified recording element, and the lightness per a predetermined area of an image obtained by the compensation dots is within a range of ±20% of the lightness per the predetermined area of the image obtained by dots intended to be recorded by said identified recording element.

9. The recording method according to claim 8, wherein the lightness of the compensation dots is lower than the lightness of dots intended to be recorded by said identified recording element.

10. A program embodied in a computer-readable medium for carrying out the method according to claim 8.

11. A program embodied in a computer-readable medium for controlling a recording apparatus for recording a color image on a recording medium by utilizing a recording head having a plurality of recording elements for recording a plurality of colors, said program comprising the steps of:

identifying a recording element, among said plurality of recording elements, which does not execute a recording operation;

when image processing operations, to compensate a corresponding position intended to be recorded by said identified recording element with different color dots, are executed, (A) controlling a number of compensation dots compensated by the recording operation to be less than a number of dots intended to be recorded by said identified recording element; and (B) controlling the lightness per a predetermined area of an image obtained by the compensation dots to be within a range of ±20% of the lightness per the predetermined area of the image obtained by dots intended to be recorded by said identified recording element.

* * * * *